US011411317B2

(12) United States Patent
Yoon et al.

(10) Patent No.: US 11,411,317 B2
(45) Date of Patent: Aug. 9, 2022

(54) DUAL BAND ANTENNA

(71) Applicant: UIF (University Industry Foundation), Yonsei University, Seoul (KR)

(72) Inventors: Young Joong Yoon, Seoul (KR); Jang Hwan Bae, Seoul (KR)

(73) Assignee: UIF (University Industry Foundation), Yonsei University, Seoul (KR)

( * ) Notice: Subject to any disclaimer, the term of this patent is extended or adjusted under 35 U.S.C. 154(b) by 0 days.

(21) Appl. No.: 17/116,730

(22) Filed: Dec. 9, 2020

(65) Prior Publication Data

US 2021/0242592 A1 Aug. 5, 2021

(30) Foreign Application Priority Data

Dec. 10, 2019 (KR) ..... 10-2019-0163267

(51) Int. Cl.

| | |
|---|---|
| ***H01Q 9/04*** | (2006.01) |
| ***H01Q 13/16*** | (2006.01) |
| ***H01Q 13/18*** | (2006.01) |
| ***H01Q 9/06*** | (2006.01) |
| ***H01Q 5/378*** | (2015.01) |
| ***H01Q 21/06*** | (2006.01) |

(52) U.S. Cl.

CPC ..... *H01Q 9/045* (2013.01); *H01Q 5/378* (2015.01); *H01Q 9/065* (2013.01); *H01Q 13/16* (2013.01); *H01Q 13/18* (2013.01); *H01Q 21/065* (2013.01)

(58) Field of Classification Search

CPC ..... H01Q 9/045; H01Q 13/16; H01Q 13/18; H01Q 5/40; H01Q 21/064; H01Q 5/335; H01Q 9/0414; H01Q 13/10

See application file for complete search history.

(56) References Cited

U.S. PATENT DOCUMENTS

| | | | | |
|---|---|---|---|---|
| 4,710,775 | A * | 12/1987 | Coe | H01Q 13/18 343/793 |
| 4,903,033 | A * | 2/1990 | Tsao | H01Q 15/244 343/700 MS |
| 6,191,740 | B1 * | 2/2001 | Kates | H01Q 5/40 343/795 |
| 6,864,840 | B2 * | 3/2005 | Zhu | H01Q 21/065 343/771 |
| 7,221,320 | B2 * | 5/2007 | Sathath | H01Q 1/38 343/700 MS |
| 8,441,404 | B2 * | 5/2013 | Chiang | H01Q 5/40 343/770 |
| 9,548,540 | B2 * | 1/2017 | Hsu | H01Q 13/106 |
| 10,431,895 | B2 * | 10/2019 | Chung | H01Q 13/106 |
| 10,658,755 | B2 * | 5/2020 | Hashimoto | H01Q 9/0457 |
| 10,879,618 | B2 * | 12/2020 | Mazaheri Kalahrudi | H01Q 13/10 |
| 2018/0219297 | A1 | 8/2018 | Chen et al. | |
| 2019/0312338 | A1 | 10/2019 | Guntupalli et al. | |

FOREIGN PATENT DOCUMENTS

KR 102028568 B1 10/2019

* cited by examiner

*Primary Examiner* — Vibol Tan

(57) ABSTRACT

The present embodiments provide a dual band antenna which divides a feed signal into two levels by a feed layer in which two layers are stacked and disposes an antenna slot in an antenna layer connected to a feed layer in a dual mode to minimize a space for an antenna.

15 Claims, 31 Drawing Sheets

[Top layer E-field at 28 GHz ]

[Top layer E-field at 39 GHz ]

[E-field at 28 GHz]

[E-field at 39 GHz]

[E-field at 28 GHz]

[E-field at 39 GHz]

DUAL BAND ANTENNA

CROSS-REFERENCE TO RELATED APPLICATIONS

This application claims priority to and the benefit of Korean Patent Application No. 10-2019-0163267 filed in the Korean Intellectual Property Office on Dec. 10, 2019, the entire contents of which are incorporated herein by reference.

TECHNICAL FIELD

The technical field of the present invention relates to an antenna which operates in a plurality of frequency bands.

BACKGROUND ART

The contents described in this section merely provide background information on the present exemplary embodiment but do not constitute the related art.

An antenna is a device which transmits and receives an electromagnetic wave in a space to achieve a communication purpose in wireless communication.

As the demand for next-generation mobile communication increases, studies on an antenna design technique and a feed structure design technique which can operate in both a frequency band used in Korea and a frequency band used in North America are necessary.

(Patent Document 1) Korean Registered Patent Publication No. 10-2028568 (Sep. 27, 2019)

SUMMARY

A major object of the present disclosure is to divide a feed signal into two levels by a feed layer in which two layers are stacked and dispose an antenna slot with a double structure in the antenna layer connected to the feed layer to minimize a space for the antenna while operating in a dual frequency band.

Other and further objects of the present invention which are not specifically described can be further considered within the scope easily deduced from the following detailed description and the effect.

According to an aspect of the present embodiment, a dual band antenna includes an antenna layer which radiates an electromagnetic wave in a dual frequency band through a dual slot; and a feed layer which applies a feed signal to the antenna layer, and the antenna layer and the feed layer are stacked.

The feed layer includes a first layer including a transmission slot and a second layer including a feed slot.

The antenna layer includes a third layer including a cavity slot and a fourth layer including an antenna slot.

The first layer and the second layer are stacked, the second layer and the third layer are stacked, and the third layer and the fourth layer are stacked.

The cavity slot of the third layer is disposed as a pair and the cavity slot pair is located at upper left and right in a diagonal direction of the feed slot of the second layer.

The antenna slot of the fourth layer is disposed in a position corresponding to the cavity slot of the third layer.

The antenna slot includes a lower band antenna slot which radiates an electromagnetic wave in a first frequency band and an upper band antenna slot which radiates an electromagnetic wave in a second frequency band.

The upper band antenna slot is disposed as a pair in the lower band antenna slot and an interval antenna slot is disposed between the upper band antenna slot pair.

The lower band antenna slot radiates an electromagnetic wave corresponding to a frequency band of 26.5 GHz to 29.5 GHz and the upper band antenna slot radiates an electromagnetic wave corresponding to a frequency band of 37.0 GHz to 40.0 GHz.

When the dual band antenna operates in the first frequency band, distributions of an electric field are different with respect to an imaginary reference line connecting the cavity slot pair and the arrangement of the polarities are different so that dual resonance is formed.

The third layer includes vias and a via which separates the electric field in the middle of the cavity slot pair is disposed and an inclined step shaped via is disposed at a lower end of the cavity slot pair.

When the dual band antenna operates in the second frequency band, distributions of an electric field are different and the arrangement of the polarities are different with respect to an imaginary reference line connecting inner corners of the cavity slot pair at a curved upper end or lower end with the inclined step shape so that dual resonance is formed.

The transmission slots of the first layer are symmetrically disposed to be spaced apart from each other to divide the feed signal received from the second layer.

The feed slots of the second layer are symmetrically disposed to be spaced apart from each other to divide the feed signal received from the first layer again.

A plurality of matching vias which matches the impedance is disposed to be close to the transmission slot of the first layer.

A plurality of matching vias which performs impedance matching is disposed close to a corner of the guide via which is disposed with an L shape in the first layer.

A plurality of matching vias for impedance matching is disposed in the center and a middle branch of the guide via which is disposed with a T shape in the first layer.

When the dual band antenna operates in a dual frequency band, a feed signal is divided by a matching via disposed in the middle of the guide via disposed with a T shape in the first layer to be transmitted to the plurality of transmission slots located in the first layer and the transmitted feed signal is divided again to be transmitted to a plurality of feed slots located in the second layer from the plurality of transmission slots at the same phase.

The second layer includes an inclined step structure transition structure connected to the feed connector.

As described above, according to the embodiments of the present disclosure, a feed signal is divided into two levels by a feed layer in which two layers are stacked and an antenna slot is disposed with a dual structure in the antenna layer connected to the feed layer to minimize a space for the antenna while operating in a dual frequency band.

Even if the effects are not explicitly mentioned here, the effects described in the following specification which are expected by the technical features of the present disclosure and their potential effects are handled as described in the specification of the present disclosure.

DETAILED DESCRIPTION OF THE EMBODIMENT

Hereinafter, in the description of the present disclosure, a detailed description of the related known functions will be omitted if it is determined that the gist of the present disclosure may be unnecessarily blurred as it is obvious to those skilled in the art and some exemplary embodiments of the present disclosure will be described in detail with reference to exemplary drawings.

The present embodiments relate to an antenna which is operable in two frequency bands and are applicable to a base station. The dual band antenna is applicable to 5G communication and an operation frequency may be set to a frequency band of 26.5 GHz to 29.5 GHz and a frequency band of 37.0 GHz to 40.0 GHz.

Figure 1:
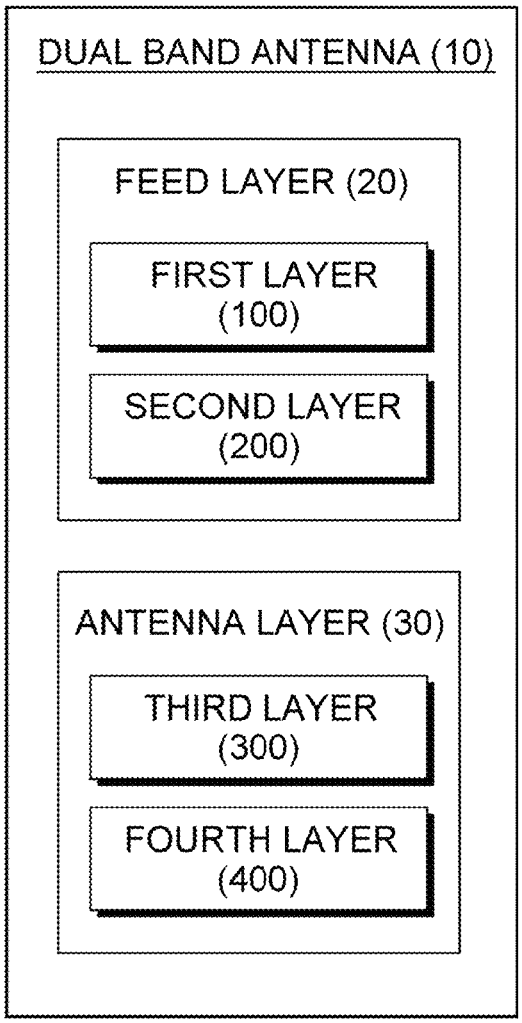
FIGS. 1 and 2 are views illustrating a dual band antenna according to an embodiment of the present invention.
Figure 2:
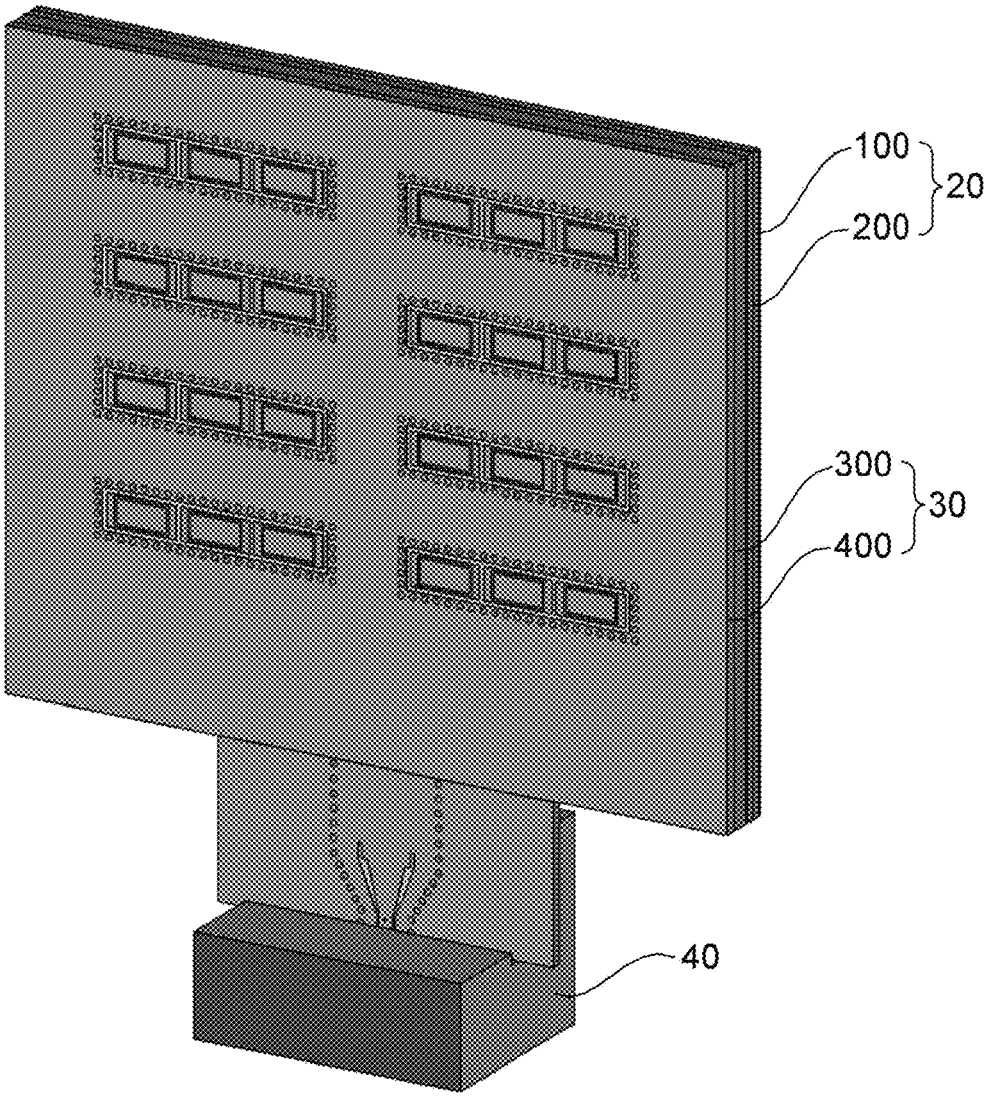
Figure 3:
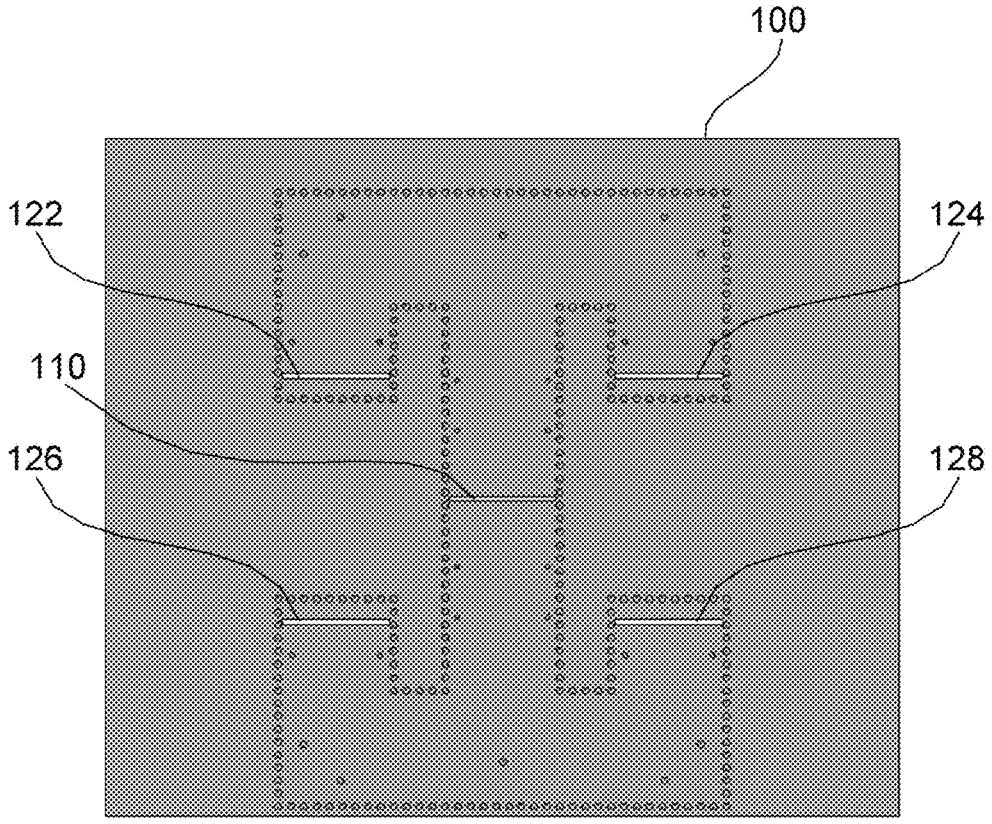
FIG. 3 is a view illustrating a first layer of a dual band antenna according to an embodiment of the present invention.
Figure 4:
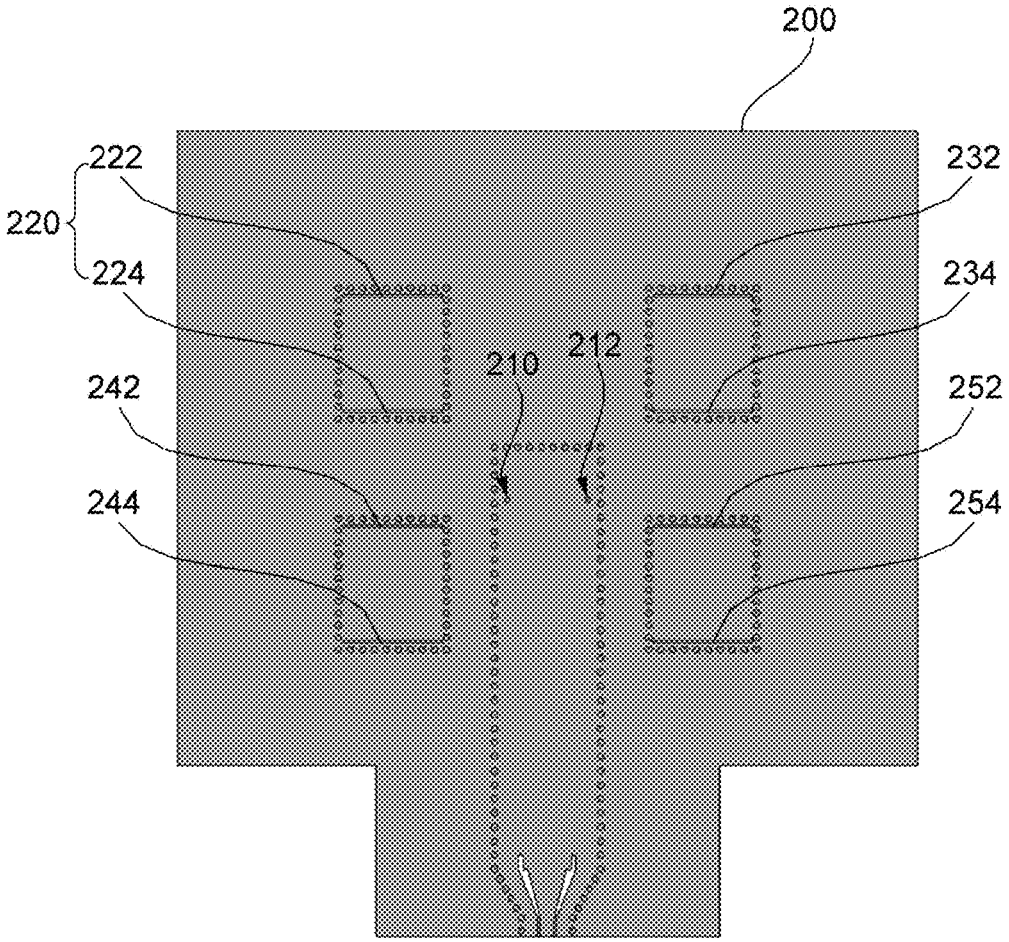
FIG. 4 is a view illustrating a second layer of a dual band antenna according to an embodiment of the present invention.
Figure 5:
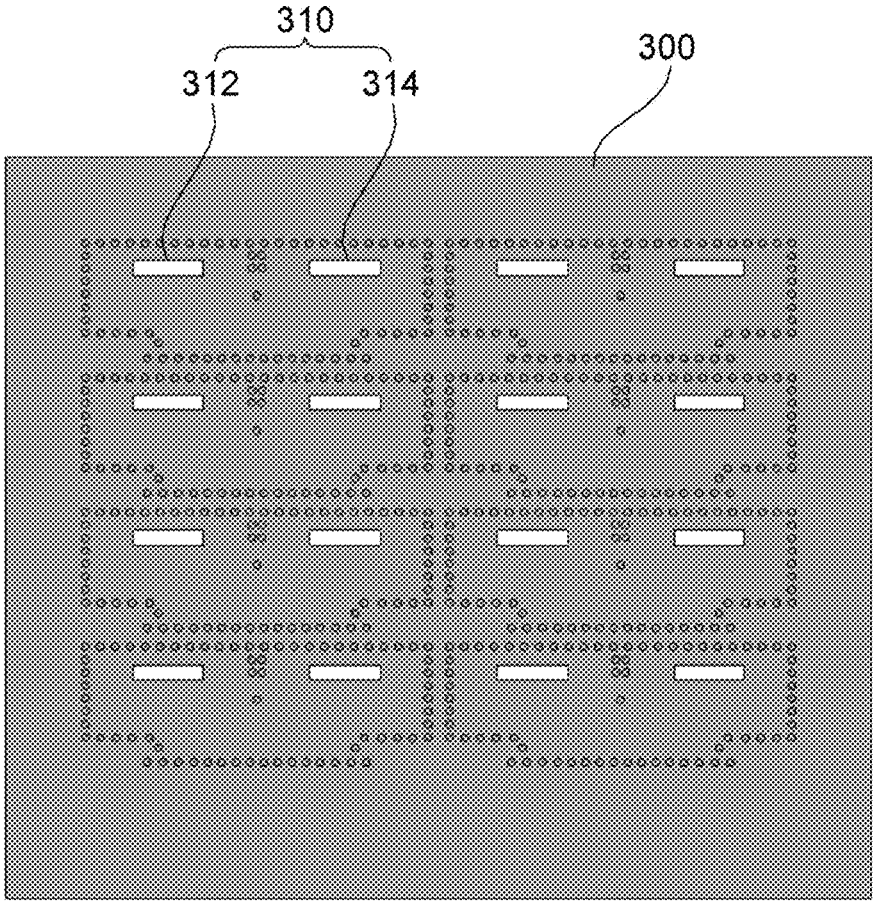
FIG. 5 is a view illustrating a third layer of a dual band antenna according to an embodiment of the present invention.
Figure 6:
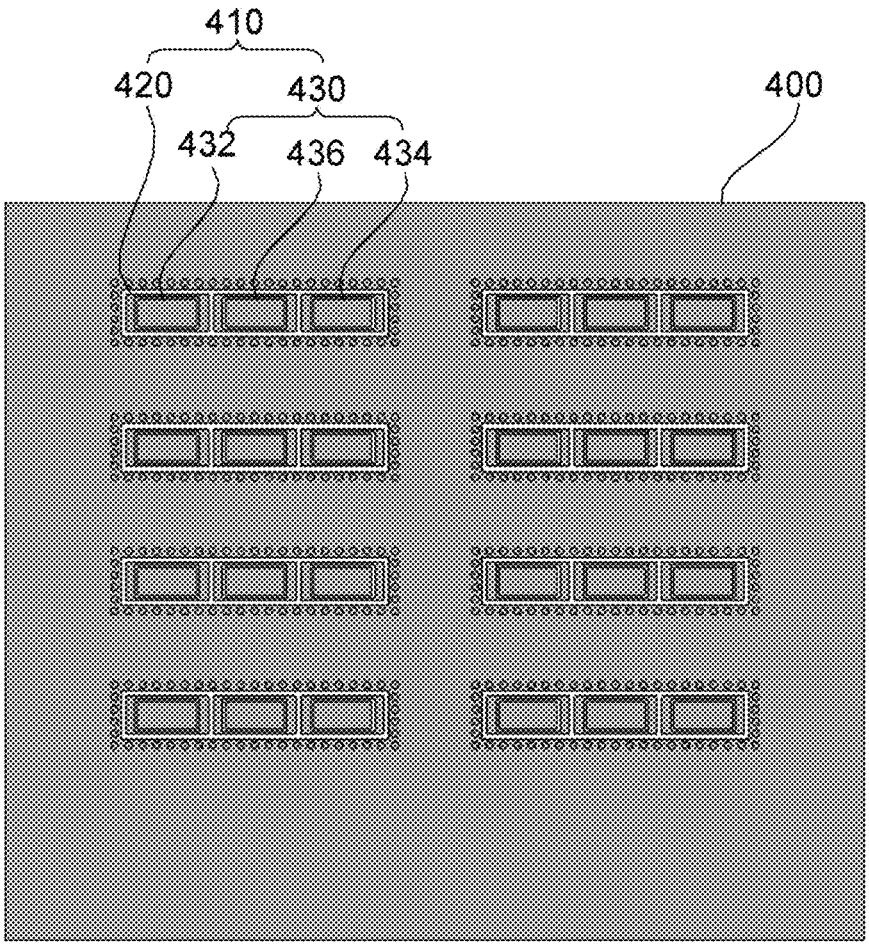
FIG. 6 is a view illustrating a fourth layer of a dual band antenna according to an embodiment of the present invention.

FIGS. 1 and 2 are views illustrating a dual band antenna according to an embodiment of the present invention, FIG. 3 is a view illustrating a first layer, FIG. 4 is a view illustrating a second layer, FIG. 5 is a view illustrating a third layer, and FIG. 6 is a view illustrating a fifth layer.

A dual band antenna 10 includes a feed layer 20 and an antenna layer 30. The dual band antenna 10 is formed with a structure in which the antenna layer 30 and the feed layer 20 are stacked.

The feed layer 20 applies a feed signal to the antenna layer 30. The feed layer 20 includes a first layer 100 including a transmission slot and a second layer 200 including a feed slot. The feed layer 20 is formed with a structure in which the first layer 100 and the second layer 200 are stacked.

The antenna layer 300 radiates an electromagnetic wave in a dual frequency band through a dual slot. The antenna layer 30 includes a third layer 300 including a cavity slot and a fourth layer 400 including an antenna slot. The antenna layer 30 is formed with a structure in which the third layer 300 and the fourth layer 400 are stacked. The second layer 200 of the feed layer 20 and the third layer 300 of the antenna layer 30 are laminated to be connected.

The first layer 100, the second layer 200, the third layer 300, and the fourth layer 400 may be implemented by substrate integrated waveguide (SIW) cavities.

The first layer 100, the second layer 200, the third layer 300, and the fourth layer 400 are formed with a slot antenna structure which operates in a specific frequency band. The slot antenna is a resonance antenna in which a hole is formed in a waveguide metal plate and a vibration energy is applied to radiate a radio wave. The slot antenna directly radiates an electromagnetic wave to slots which are formed on one surface of the waveguide with a predetermined interval. The slot is formed on a dielectric substrate. The slot antenna may adjust impedance matching in consideration of a size, a number, a position, and a length of cavities or slots.

The feed signal is transmitted from a feed connector 40 to feed vias 210 and 212 of the second layer 200. A barrier of a signal path is formed along a guide via of the second layer 200. The second layer 200 performs a feed function.

The feed signal is transmitted to the transmission slot 110 of the first layer 100 from the feed vias 210 and 212 of the second layer 200. The feed vias and the transmission slot are electromagnetically coupled. A barrier of a signal path is formed along a guide via of the first layer 100.

The transmission slots 122, 124, 126, and 128 of the first layer 100 are symmetrically disposed to be spaced apart from each other to divide the feed signal received from the second layer 200. The first layer 100 divides the signal by disposing the transmission slots. Here, the first layer 100 may divide the signal into four parts.

The feed signal is transmitted from the transmission slots 122, 124, 126, and 128 of the first layer to feed slots 222, 224, 232, 234, 242, 244, 252, and 254 of the second layer 200 again. The transmission vias and the feed slots are electromagnetically coupled. A barrier of a signal path is formed along a guide via of the second layer 200.

The transmission slots 222, 224, 232, 234, 242, 244, 252, and 254 of the second layer 200 are symmetrically disposed to be spaced apart from each other to divide the feed signal received from the first layer 100 again. The feed slot 200 may be disposed as a pair 222 and 224. The second layer 200 divides the signal by disposing the transmission slots. Here, the first layer 200 may divide the signal into two parts.

A phase of the signal may be controlled by a length and a distance of the feed slots which are designed in consideration of a length and an arrangement of the transmission slots. Signals applied to the plurality of feed slots 222, 224, 232, 234, 242, 244, 252, and 254 are adjusted in phase so that all the elements of the dual band antenna radiate the electromagnetic wave with the same phase.

The signal is radiated through the antenna slot 410 of the fourth layer 400 via a cavity slot 310 of the third layer 300. The feed slot 222 and the cavity slot 310 are electromagnetically coupled and the cavity slot 310 and the antenna slot 410 are electromagnetically coupled.

The dual band antenna transmits an electromagnetic energy through a slot in which the second layer 200, the first layer 100, the second layer 200, the third layer 300, and the fourth layer 400 are coupled in this order and radiates the signal to the free space. Sizes of the layer and the slot are designed in consideration of the operation frequency. An impedance matching point may be adjusted in consideration of a size, a number, a position, and a length of cavities or slots in each layer.

Figure 7A:
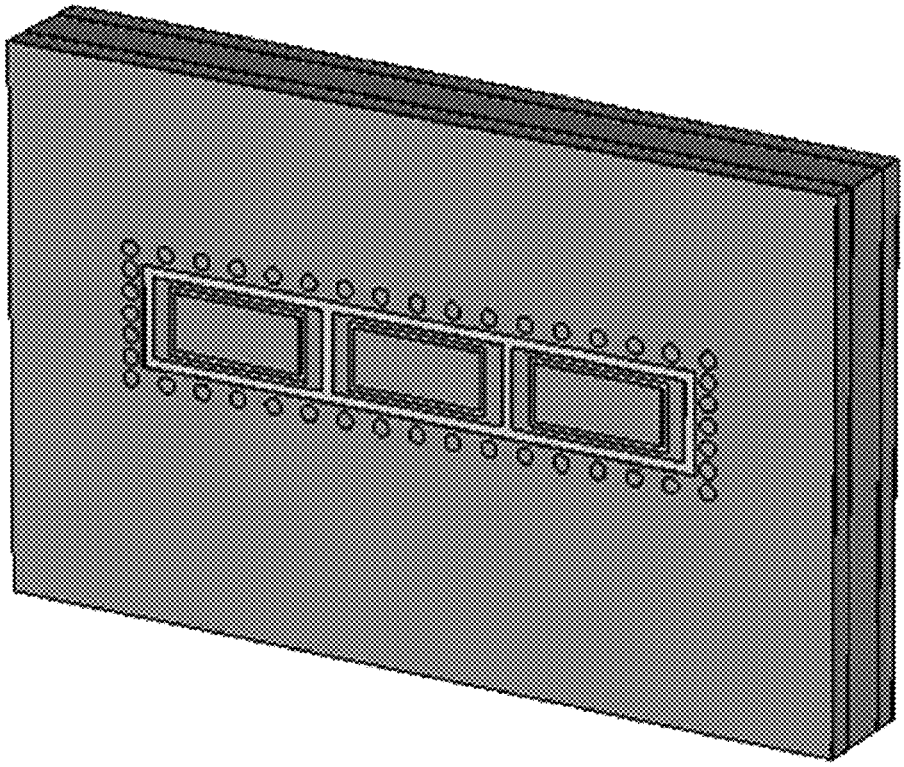
FIGS. 7A-7D are views illustrating a single element and each layer of a dual band antenna according to an embodiment of the present invention.
Figure 7B:
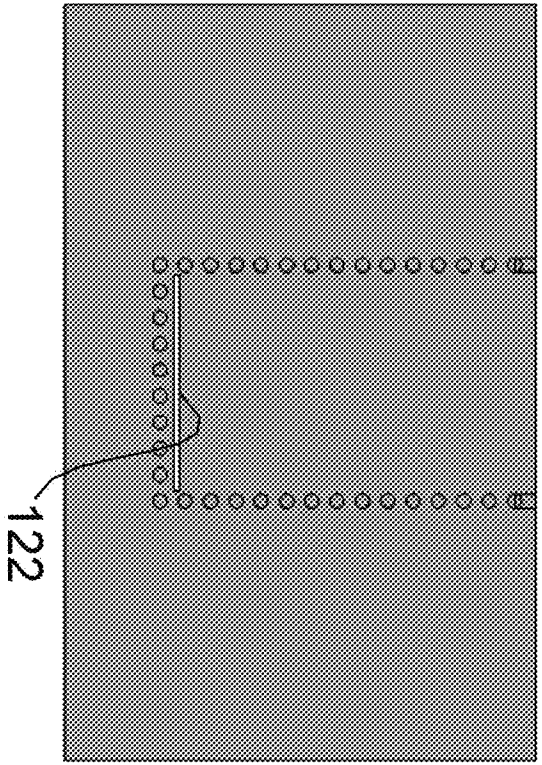
Figure 7C:
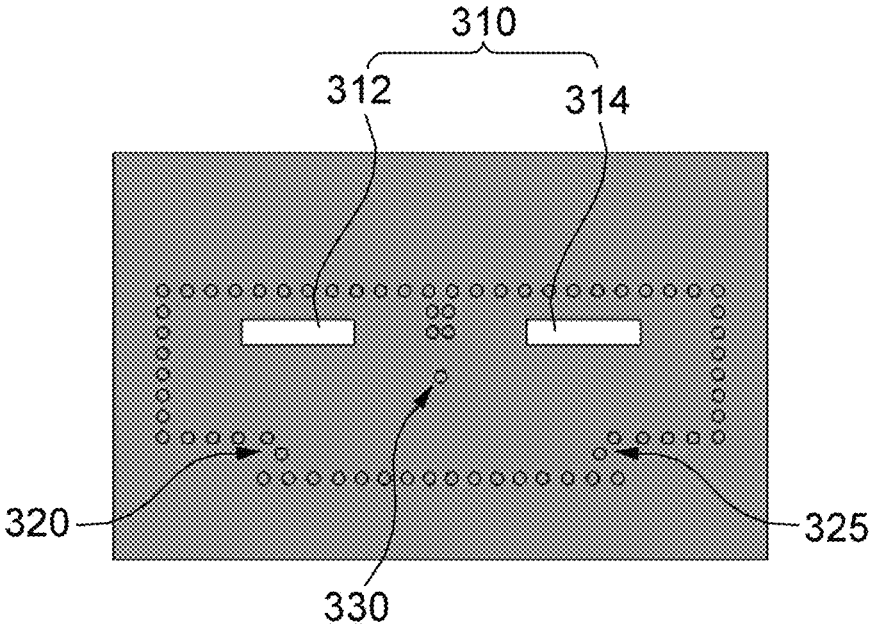
Figure 7D:
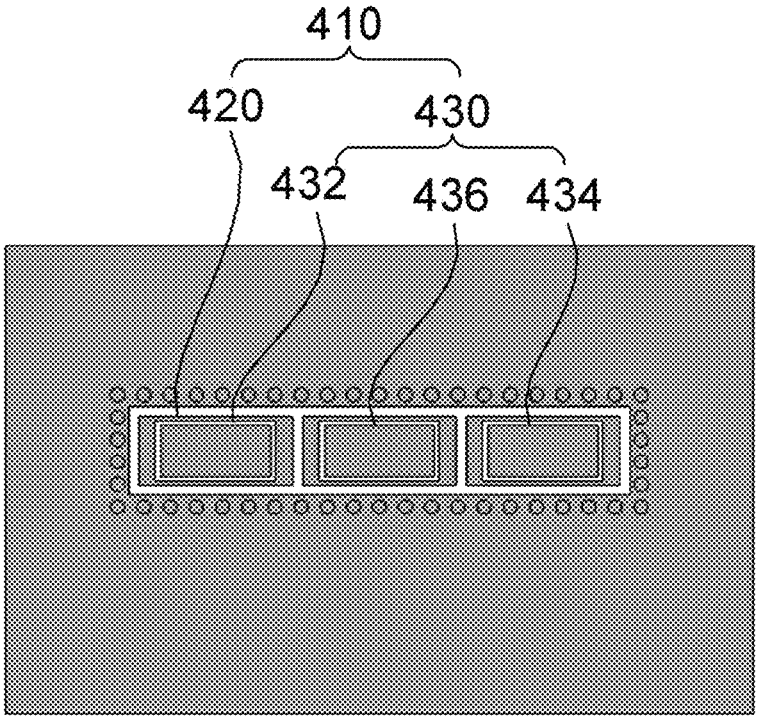
Figure 8:
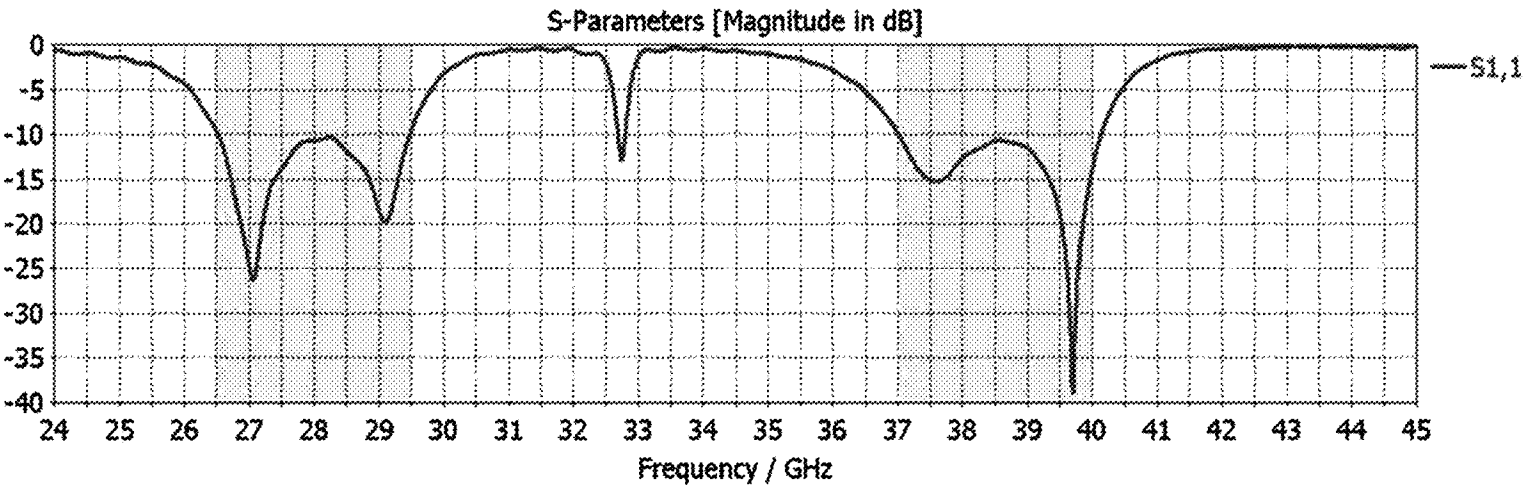
FIGS. 8 and 9 are views illustrating a frequency characteristic of a dual band antenna according to an embodiment of the present invention.
Figure 9:
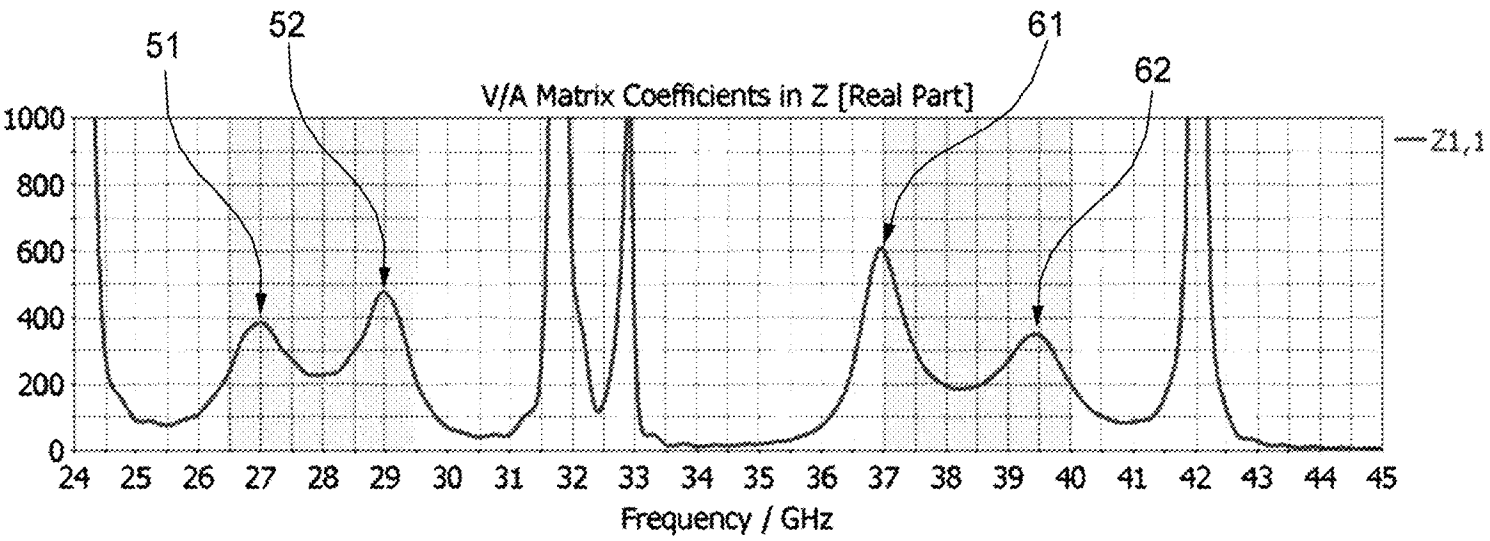

FIG. 7 is a view illustrating a signal element and each layer of a dual band antenna and FIGS. 8 and 9 are views illustrating a frequency characteristic of a dual band antenna according to an embodiment of the present invention.

The single element of the antenna illustrated in FIG. 7A is an antenna module in which a second layer of FIG. 7B, a third layer of FIG. 7C, and a fourth layer of FIG. 7D are laminated.

Referring to FIG. 7C, the cavity slot 310 of the third layer is disposed as a pair and the cavity slot pair 312 and 314 may be disposed at upper left and right in a diagonal direction of the feed slot 122 of the second layer.

The third layer includes a via and a via 330 which divides an electric field in the middle of the cavity slot pair 312 and 314 is disposed and vias 320 and 325 are disposed with an inclined step shape at the lower end of the cavity slot pair. The inclined step shape may be an 'h' shape.

The via pair 320 and 325 disposed with an inclined step shape may be disposed to have a symmetrical structure in which the via pairs are reflected on a mirror with respect to an imaginary reference line passing through a dividing via 330 in the middle.

The feed slot 122 of the second layer may be disposed in a position corresponding to the dividing via 330 in the middle of the third layer and the center of the via pair 320 and 325 with an inclined step shape.

The antenna slot 410 includes a lower band antenna slot 420 which radiates an electromagnetic wave in a first frequency band and an upper band antenna slot 430 which radiates an electromagnetic wave in a second frequency band.

A pair of upper band antenna slots 430 is disposed in the lower band antenna slot 420 and an interval antenna slot 436 is disposed between the upper band antenna slot pair 432 and 434.

The antenna slot 410 of the fourth layer is disposed in a position corresponding to the cavity slot 310 of the third layer. The upper band antenna slot pair 432 and 434 of the fourth layer is disposed in a position corresponding to the cavity slot pair 312 and 314 of the third layer. The corresponding position refers to a position where areas of the stacked layers overlap.

Referring to FIGS. 8 and 9, the single element of the dual band antenna operates in a frequency band of 26.5 GHz to 29.5 GHz and a frequency band of 37.0 GHz to 40.0 GHz and has a band width of 3 GHz in two frequency bands.

Referring to FIG. 9, the dual band antenna has dual resonance points 51 and 52 in the lower frequency band and dual resonance points 61 and 62 in the upper frequency band. This is a result of the double arrangement of the slot.

Figure 10:
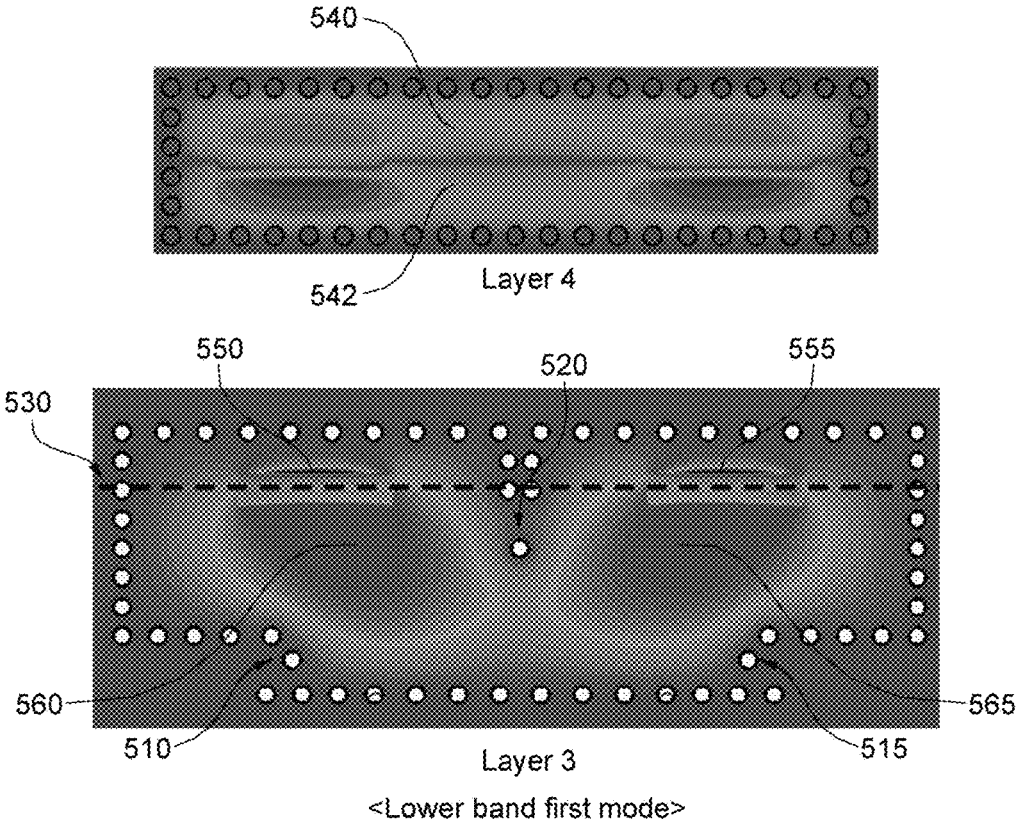
FIGS. 10 to 13 are views illustrating a field characteristic of a dual band antenna according to an embodiment of the present invention.
Figure 11:
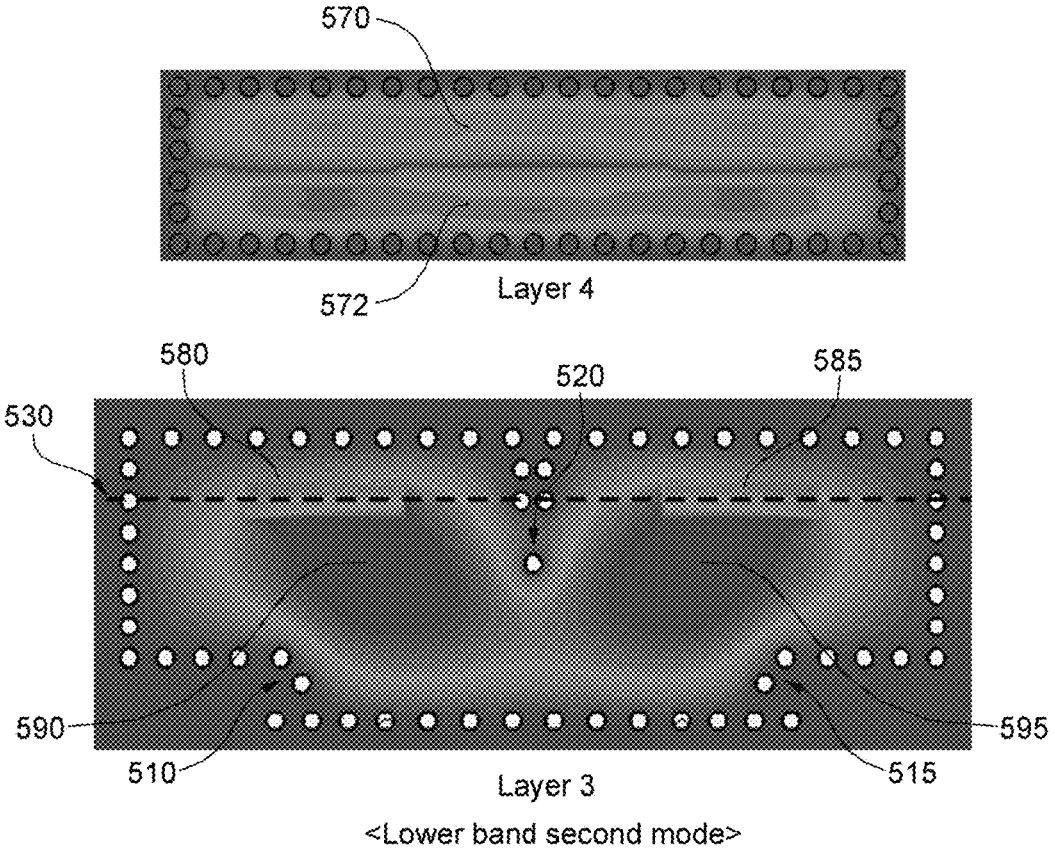

FIGS. 10 and 11 are views illustrating a field characteristic of a lower frequency band of a dual band antenna according to an embodiment of the present invention. The field characteristic represents a direction, a phase, or a polarity of an electric field.

A mode of the lower frequency band using a Z real part operates in a first mode and a second mode. FIG. 10 illustrates a first mode of a lower frequency band according to a resonance point 51 and FIG. 11 illustrates a second mode of a lower frequency band according to a resonance point 52.

Electric fields formed in the third layer and the fourth layer in the first mode and the second mode of the lower frequency band have different distribution patterns. When the dual band antenna operates in the first frequency band, distribution of the electric field is different and the arrangement of the polarity is different with respect to an imaginary reference line 530 which connects the cavity slot pair to form dual resonance.

In the first mode of the lower frequency band of FIG. 10, polarities 550 and 555 of the electric field in an upper portion of the imaginary reference line 530 of the third layer are opposite to polarities 560 and 565 of the electric field in a lower portion of the imaginary reference line 530. Polarities 540 and 542 are opposite to each other and polarities 550 and 560 are opposite to each other. The polarities 550 and 555 are the same polarity and the polarities 560 and 565 are the same polarity.

In contrast, in the second mode of the lower frequency band of FIG. 11, polarities of the electric field in an upper portion of the imaginary reference line 530 of the third layer are not opposite to polarities 590 and 595 of the electric field in a lower portion of the imaginary reference line 530. Polarities 570 and 572 are opposite and the polarities 590 and 595 are the same polarity.

Figure 12:
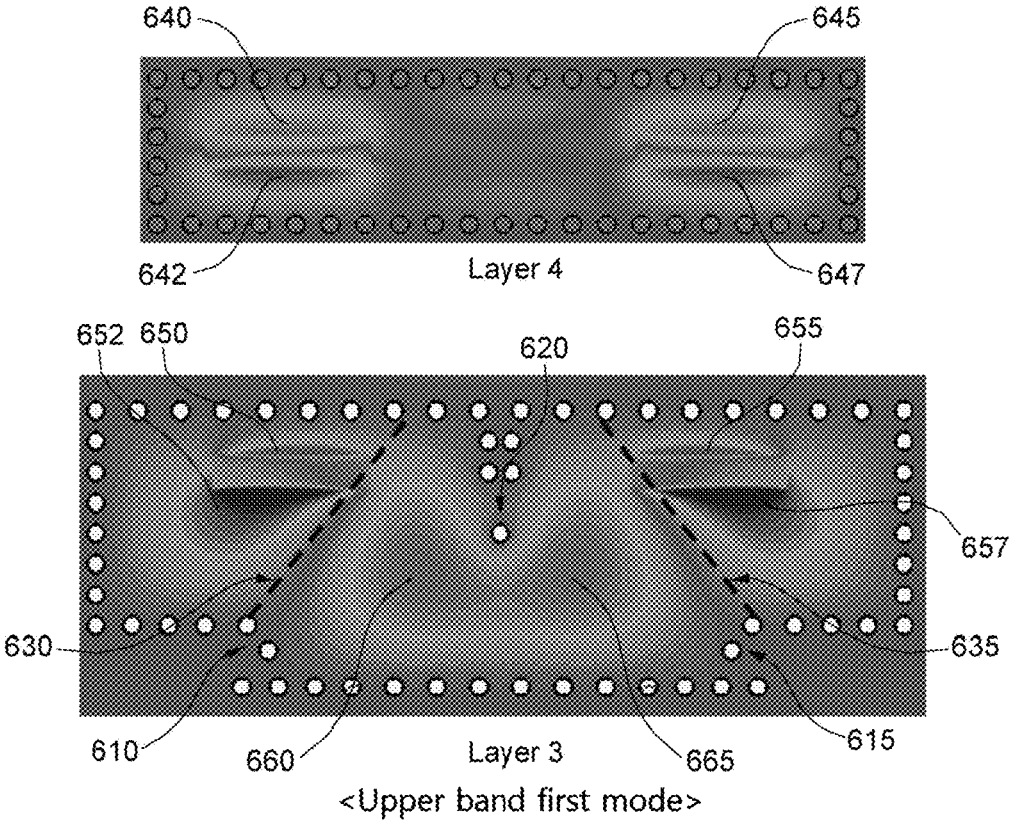
Figure 13:
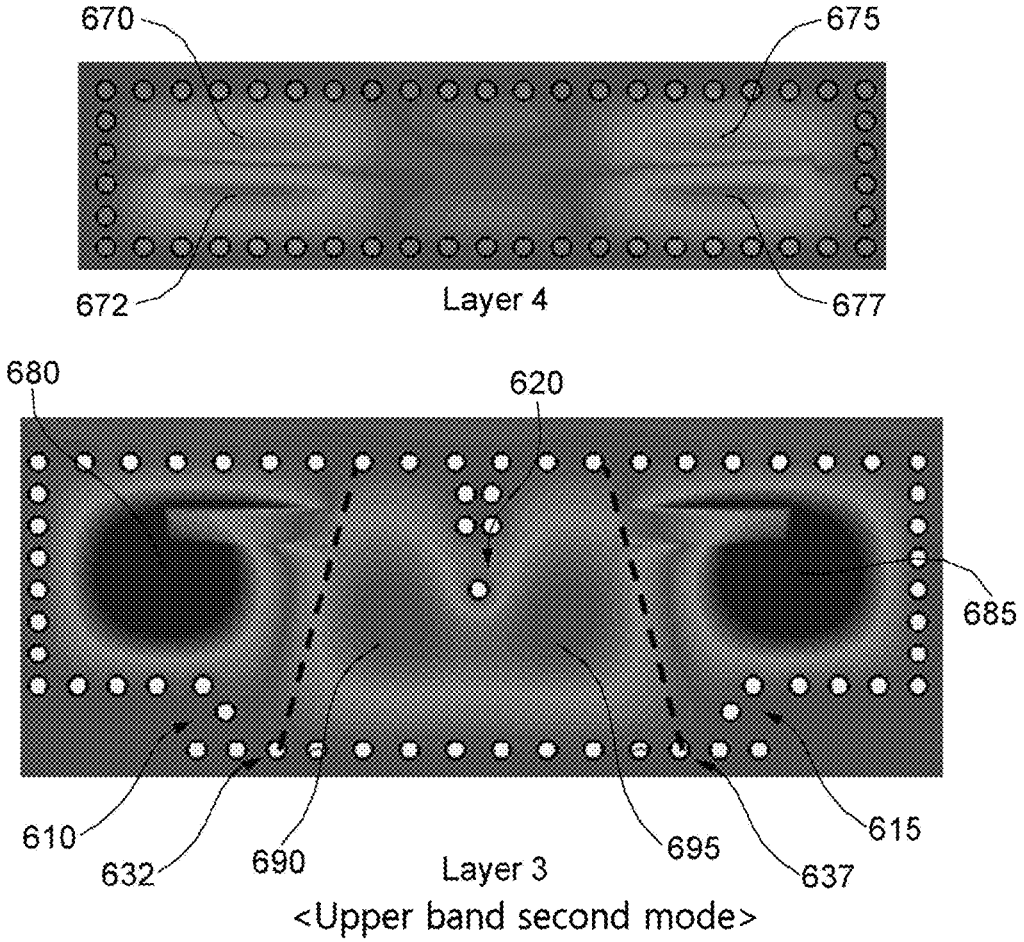

FIGS. 12 and 13 are views illustrating a field characteristic of an upper frequency band of a dual band antenna according to an embodiment of the present invention. The field characteristic represents a direction, a phase, or a polarity of an electric field.

A mode of the upper frequency band using a Z real part operates in a first mode and a second mode. FIG. 12 illustrates a first mode of an upper frequency band according to a resonance point 61 and FIG. 13 illustrates a second mode of an upper frequency band according to a resonance point 62. Electric fields formed in the third layer and the fourth layer in the first mode and the second mode of the upper frequency band have different distribution patterns. When the dual band antenna operates in the second frequency band, the distribution of the electric field is different and the polarities are different with respect to (1) imaginary reference lines 630 and 635 which connect inner corners of the cavity slot pair from upper curved points of the inclined step shapes 610 and 615 or (ii) imaginary reference lines 632 and 637 which connect inner corners of the cavity slot pair from lower curved points of the inclined step shapes 610 and 615, so that dual resonance is formed.

In the first mode of the upper frequency band of FIG. 12, polarities 650 and 655 of the electric field in an upper portion of the cavity slot pair of the third layer are opposite to polarities 652 and 657 of the electric field in a lower portion of the cavity slot pair. The polarities 652 and 660 of the electric field are opposite with respect to an imaginary reference line 630 which connects inner corners of the cavity slot pair from the upper curved points of the inclined step shapes 610 and 615. The polarities 640 and 642 are opposite polarities, the polarities 650 and 652 are opposite polarities, and reference numerals 652 and 660 are opposite polarities. The polarities 640 and 645 are the same polarity and the polarities 642 and 647 are the same polarity. The polarities 650 and 655 are the same polarity, the polarities 652 and 657 are the same polarity, and the polarities 660 and 665 are the same polarity.

In contrast, in the second mode of the upper frequency band of FIG. 13, the polarities 680 and 685 of the electric fields in the upper portion of the cavity slot pair and the lower portion of the cavity slot pair of the third layer are the same. The polarities 680 and 690 of the electric field are opposite with respect to an imaginary reference line 632 which connects inner corners of the cavity slot pair from the lower curved points of the inclined step shapes 610 and 615. Polarities 670 and 672 are opposite and polarities 680 and 690 are opposite. The polarities 670 and 675 are the same polarity and the polarities 672 and 677 are the same polarity. The polarities 680 and 685 are the same polarity and the polarities 690 and 695 are the same polarity.

The electric fields of the third layer and the fourth layer illustrated in FIGS. 10 to 13 are formed with a bilaterally symmetric structure.

Figure 14:
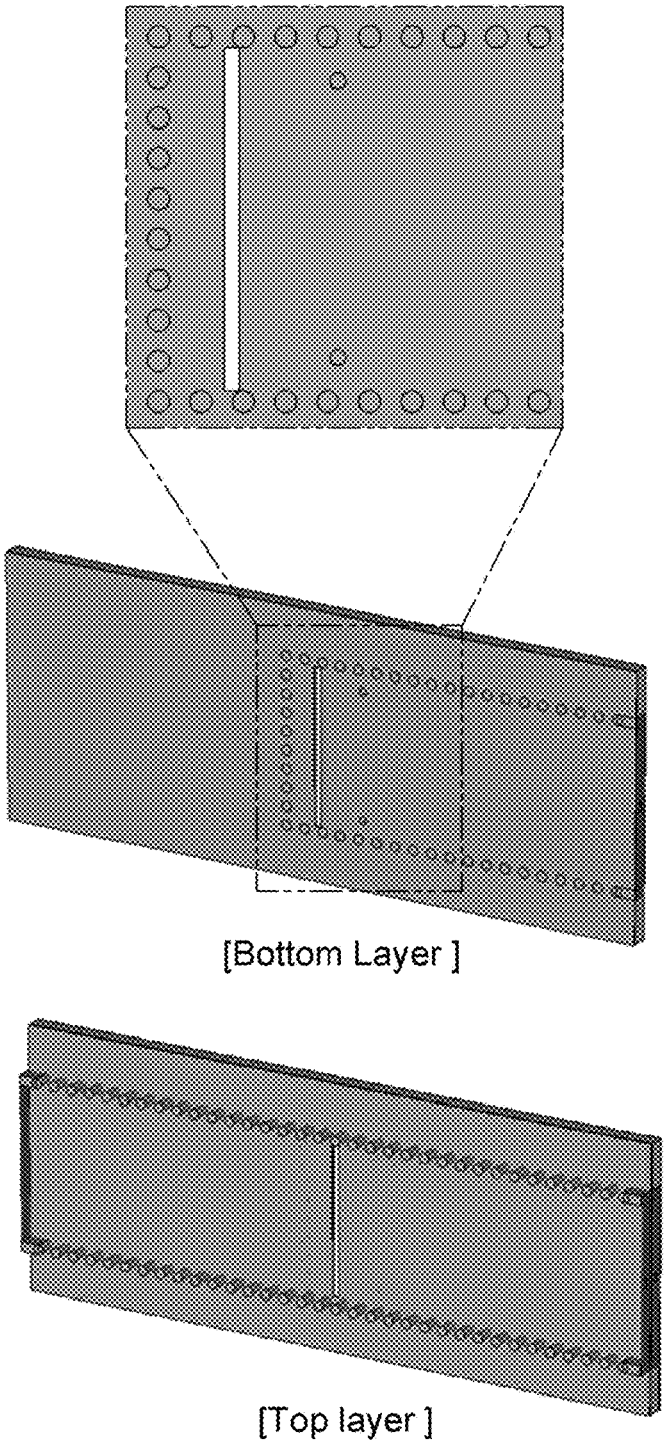
FIG. 14 is a view illustrating a feed structure of a dual band antenna according to another embodiment of the present invention.
Figure 15:
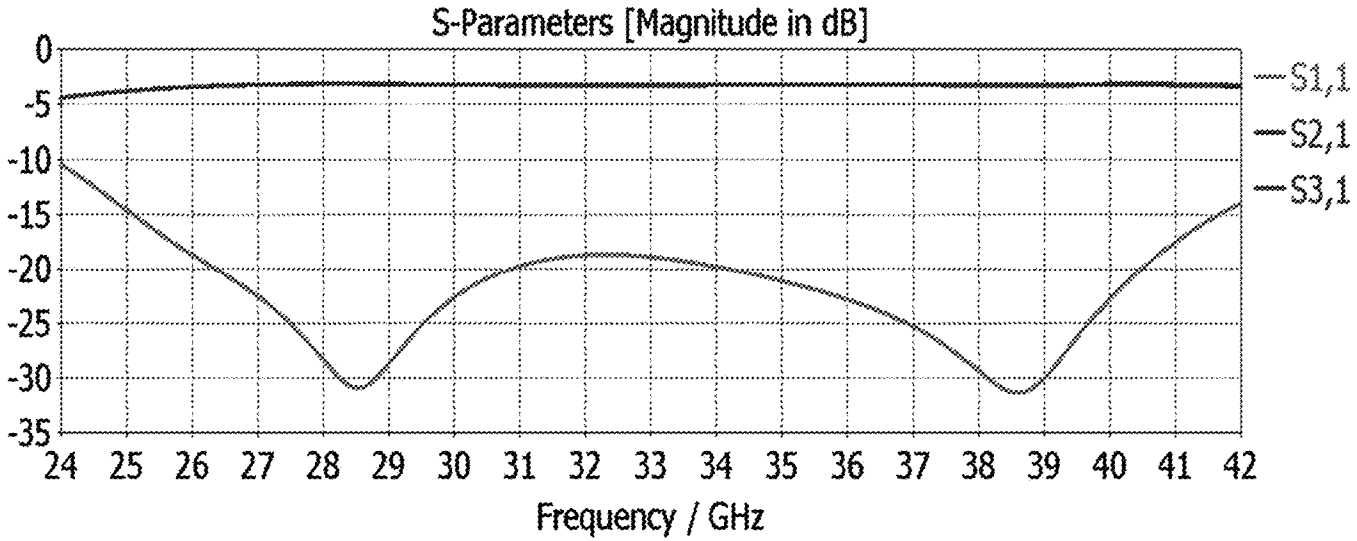
FIG. 15 is a view illustrating a frequency characteristic of a feed structure of a dual band antenna according to another embodiment of the present invention.
Figure 16:
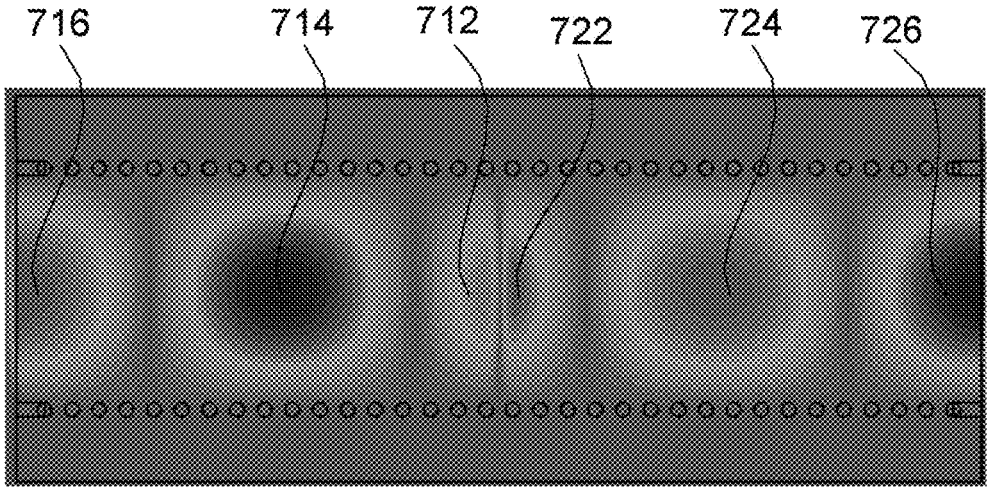
FIG. 16 is a view illustrating a field characteristic of a feed structure of a dual band antenna according to another embodiment of the present invention.
Figure 16:
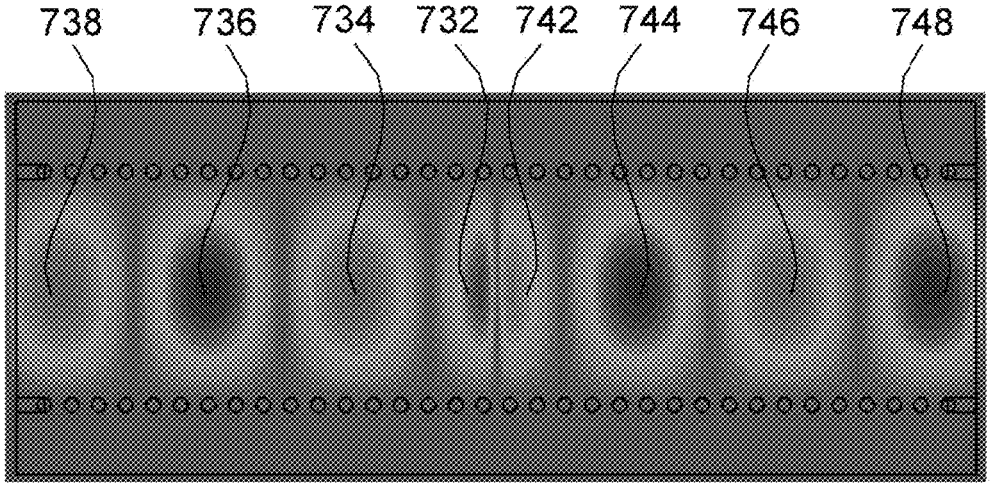

FIG. 14 is a view illustrating a feed structure of a dual band antenna according to another embodiment of the present invention, FIG. 15 is a view illustrating a frequency characteristic of a feed structure, and FIG. 16 is a view illustrating a field characteristic of a feed structure.

The feed layer of the dual band antenna is a two-layered SIW power divider with a phase difference of 180 degrees. An inductive via is designed on a first layer corresponding to the lower end for impedance matching. The upper layer may hide the lower layer.

A plurality of matching vias for impedance matching is disposed to be close to the transmission slot of the first layer of the dual band antenna. The via performs the impedance matching in a dual band.

Figure 17:
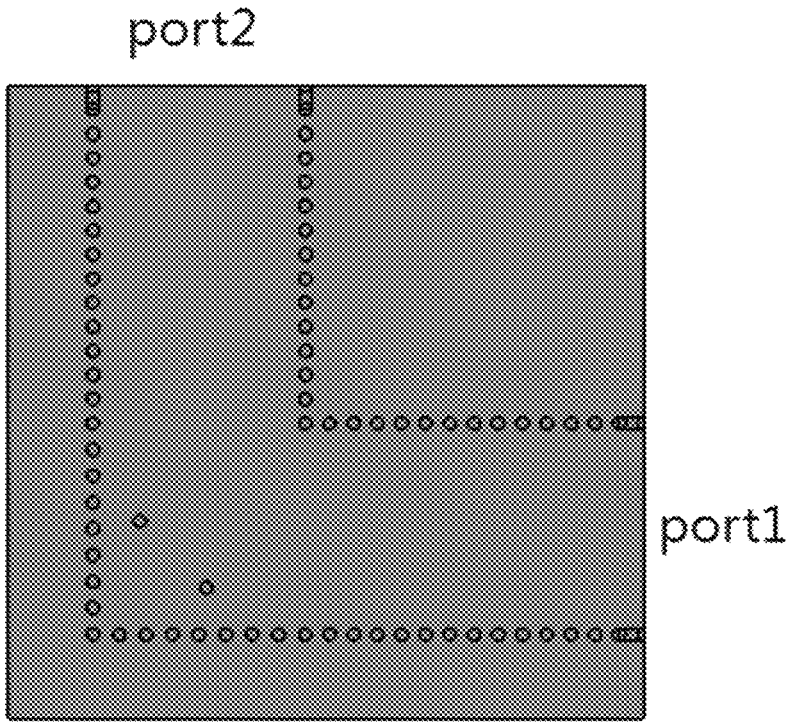
FIG. 17 is a view illustrating an L-shaped structure of a dual band antenna according to another embodiment of the present invention.
Figure 18:
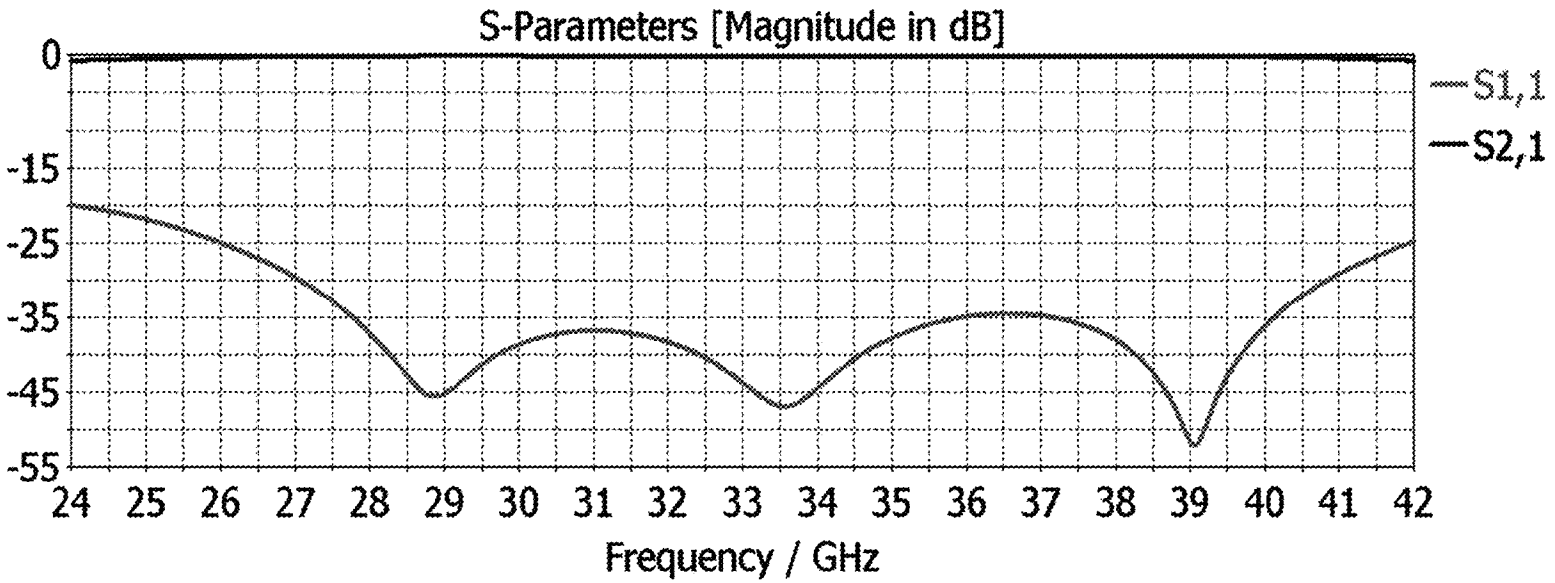
FIG. 18 is a view illustrating a frequency characteristic of an L-shaped structure of a dual band antenna according to another embodiment of the present invention.

Referring to FIG. 16, it is understood that the polarities of the electric fields are opposite with respect to the transmission slot and the distributions 712, 714, 716, 722, 724, 726, 732, 734, 736, 738, 742, 744, 746, and 748 of the electric field in the impedance matching dual frequency band or areas are different. Polarities 712 and 722 are opposite and polarities 732 and 742 are opposite. Polarities 712, 716, and 724 are the same polarity and polarities, 726, and 714 are the same polarity. Polarities 732, 736, 744, and 748 are the same polarity and polarities 742, 746, 734, and 738 are the same polarity FIG. 17 is a view illustrating an L-shaped structure of a dual band antenna according to another embodiment of the present invention, FIG. 18 is a view illustrating a frequency characteristic of an L shaped structure of the dual band antenna, and FIG. 19 is a view illustrating a field characteristic of an L shaped structure of the dual band antenna.

A first layer of the dual band antenna has an SIW structure which is curved at 90 degrees. The first layer uses two vias to perform impedance matching. A plurality of matching vias which performs impedance matching is disposed close to a corner of the guide via which is disposed with an L shape in the first layer of the dual band antenna. The matching via prevents reflection distortion in the 90-degree structure.

Figure 19:
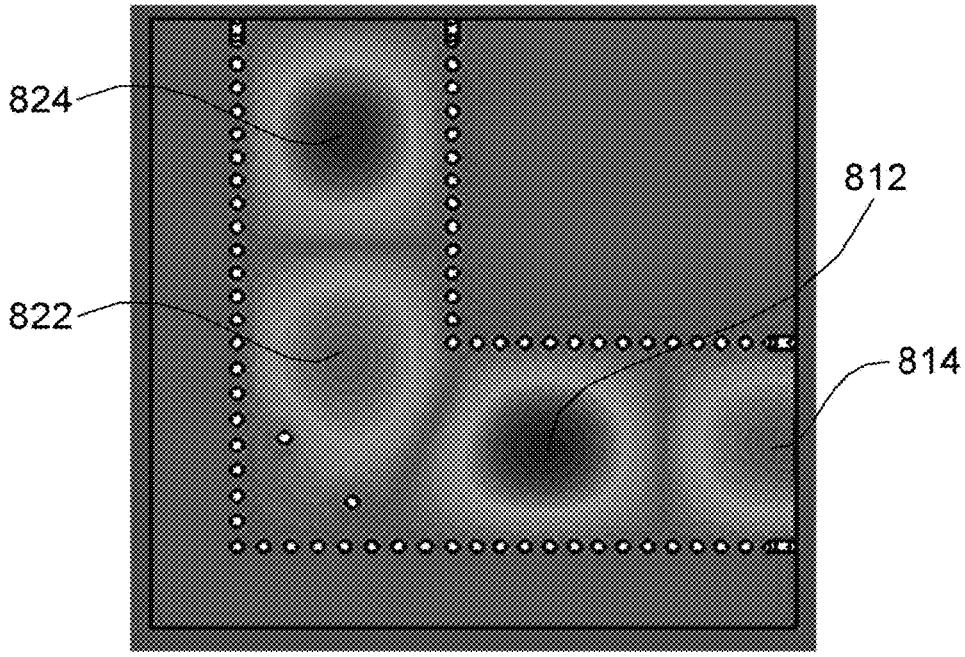
FIG. 19 is a view illustrating a field characteristic of an L-shaped structure of a dual band antenna according to another embodiment of the present invention.
Figure 19:
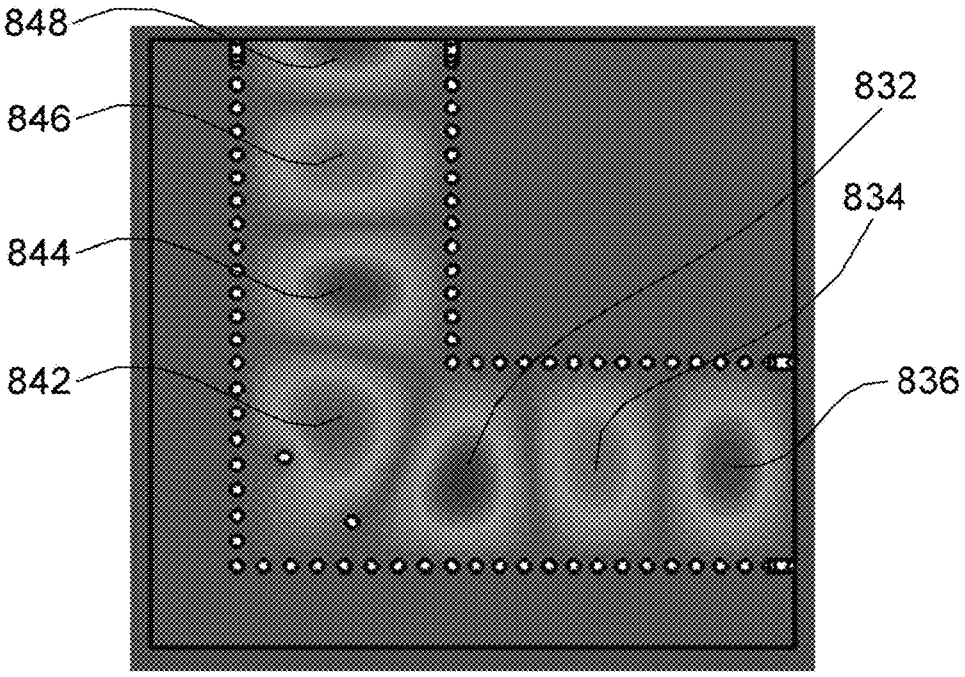
Figure 20:
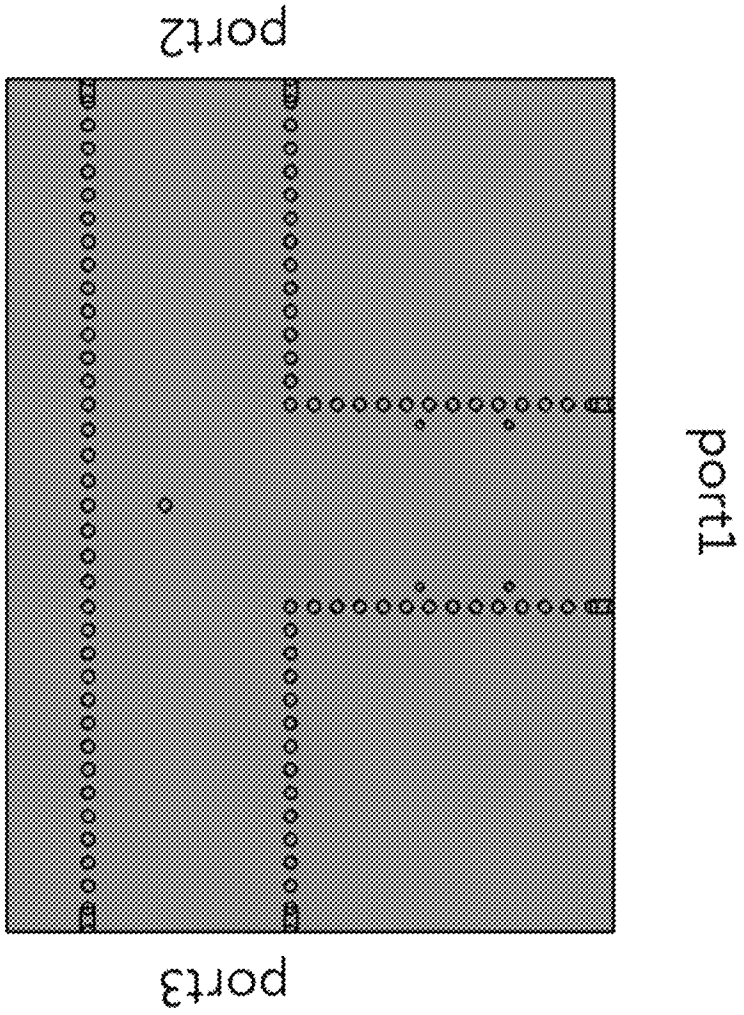
FIG. 20 is a view illustrating a T-shaped structure of a dual band antenna according to another embodiment of the present invention.
Figure 21:
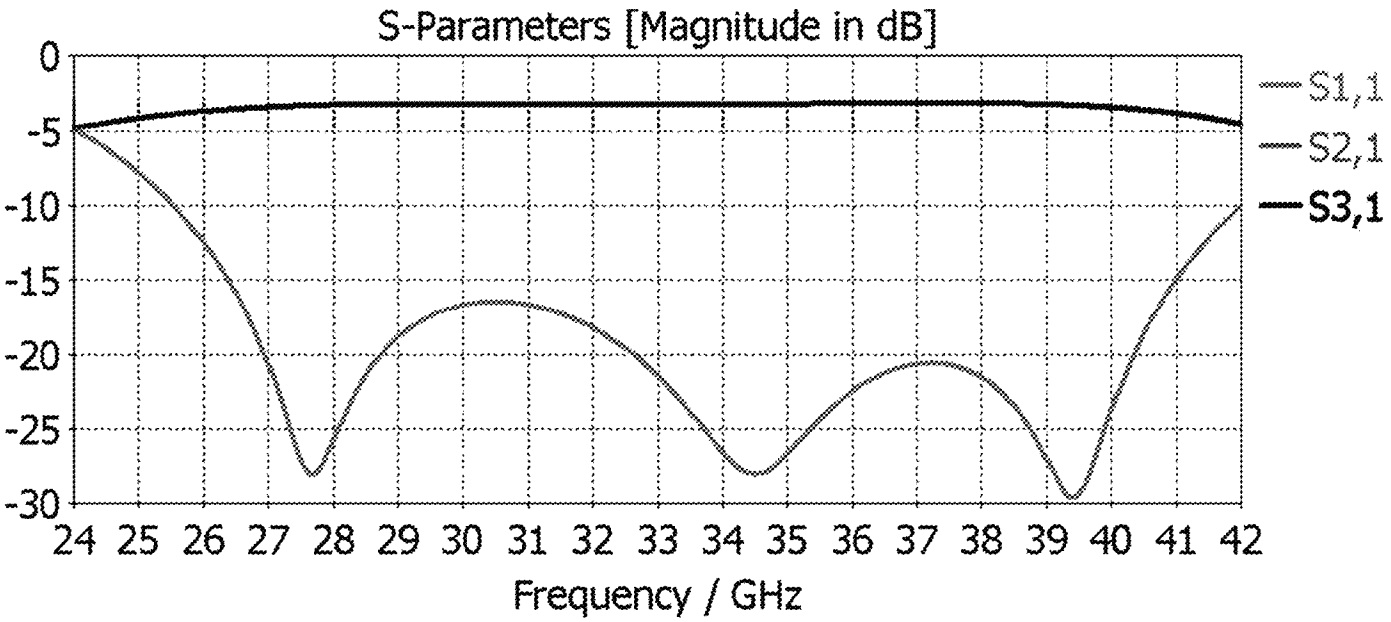
FIG. 21 is a view illustrating a frequency characteristic of a T-shaped structure of a dual band antenna according to another embodiment of the present invention.

Referring to FIG. 19, it is understood that the distributions 812, 814, 822, 824, 832, 834, 836, 842, 844, 846, 848 of the electric field or the areas are different in the dual frequency band. The polarities 812 and 824 are the same polarity and the polarities 822 and 814 are the same polarity. The polarities 832, 836, 844, and 848 are the same polarity and the polarities 842, 846, 834, and 834 are the same polarity FIG. 20 is a view illustrating a T-shaped structure of a dual band antenna according to another embodiment of the present invention, FIG. 21 is a view illustrating a frequency characteristic of a T shaped structure of the dual band antenna, and FIG. 22 is a view illustrating a field characteristic of a T shaped structure of the dual band antenna.

The first layer of the dual band antenna is an in-phase single layered dual band SIW power divider. The first layer uses five vias to perform impedance matching. One matching via is disposed at the center of the guide via which is disposed on the first layer of the dual band antenna with a T shape and four matching vias for impedance matching are disposed in a middle branch of the guide via. One matching via located at the center of the guide via divides the signal. Four matching vias located in the middle branch of the guide via perform the impedance matching in a dual band. The guide via is configured such that T shaped pairs are opposite. The guide via forms a T shaped pair structure which is reflected from the mirror.

Figure 22:
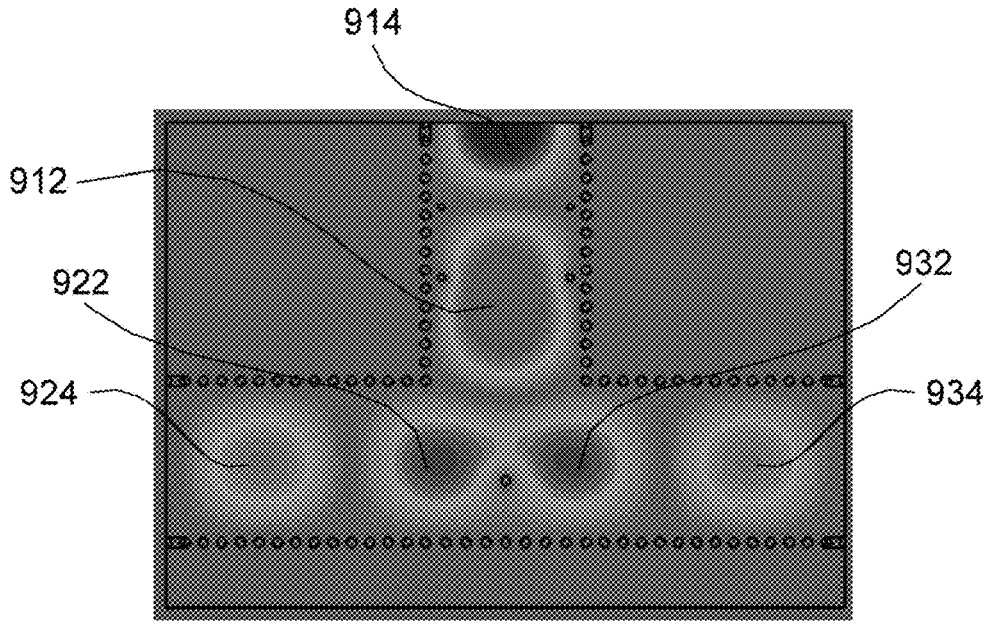
FIG. 22 is a view illustrating a field characteristic of a T-shaped structure of a dual band antenna according to another embodiment of the present invention.
Figure 22:
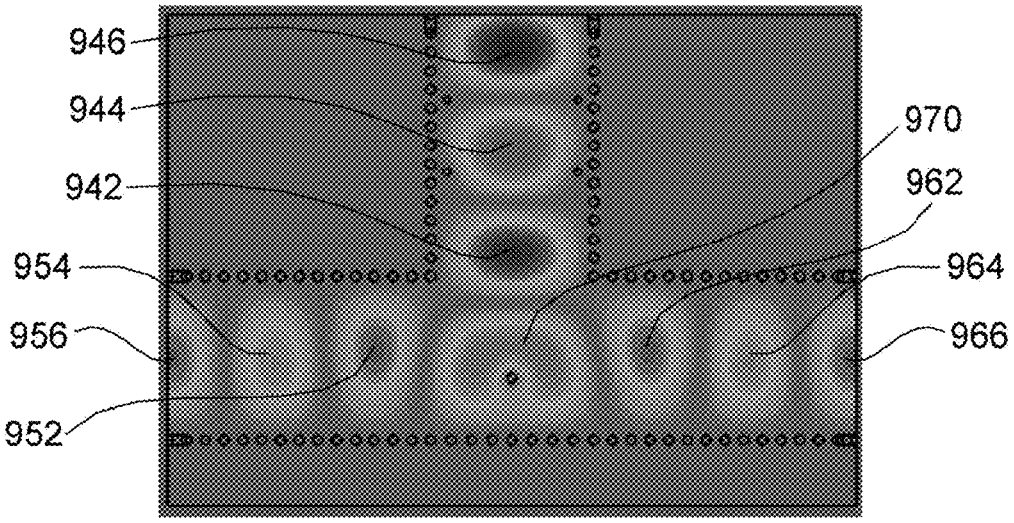

Referring to FIG. 22, it is understood that the distributions 912, 914, 922, 924, 932, 934, 942, 944, 946, 952, 954, 956, 962, 964, 966, 970 of the electric field or the areas are different in the dual frequency band. The polarities 912, 924, and 934 are the same polarity and the polarities 922, 932, and 914 are the same polarity. The polarities 70, 944, 954, and 964 are the same polarity and the polarities 942, 946, 952, 956, 962, and 966 are the same polarity.

When the dual band antenna operates in a dual frequency band, the feed signal is divided by the matching via located at the center of the guide via disposed with a T shape to transmit the divided feed signal to the plurality of transmission slots located on the first layer. The dual band antenna divides the transmitted feed signal again to transmit the feed signal from the plurality of transmission slots to the plurality of feed slots located on the second layer in phase. The in-phase signal is applied to the plurality of feed slots 222, 224, 232, 234, 242, 244, 252, and 254 of the second layer illustrated in FIG. 4.

Figure 23:
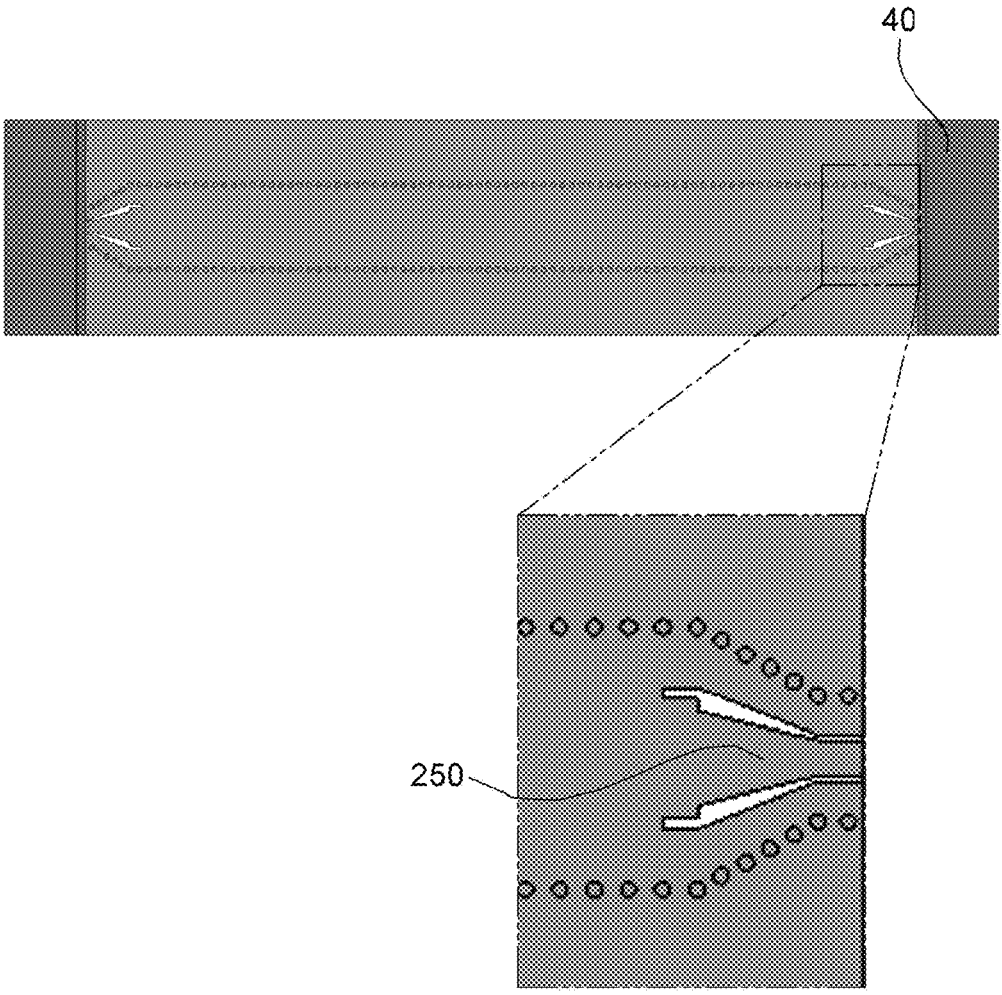
FIG. 23 is a view illustrating a transition structure of a dual band antenna according to another embodiment of the present invention.
Figure 24:
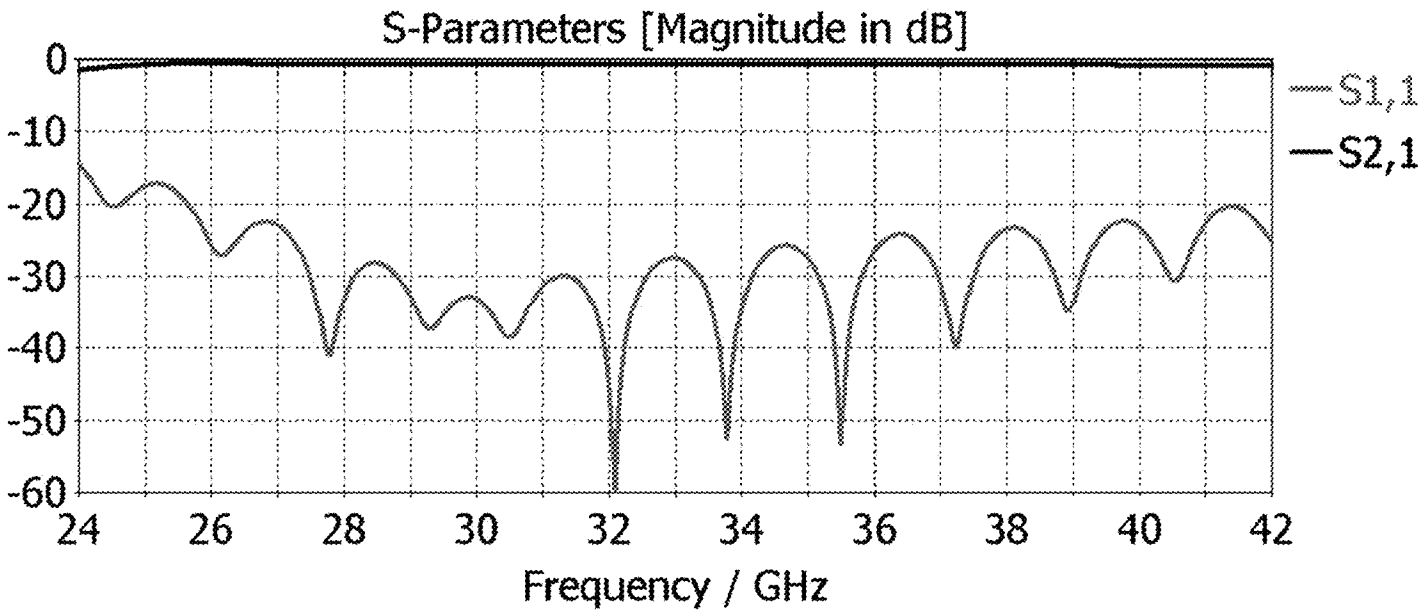
FIG. 24 is a view illustrating a frequency characteristic of a transition structure of a dual band antenna according to another embodiment of the present invention.

FIG. 23 is a view illustrating a transition structure of a dual band antenna according to another embodiment of the present invention and FIG. 24 is a view illustrating a frequency characteristic of a transition structure of the dual band antenna.

The second layer includes an inclined step structure transition structure 250 connected to the feed connector 40. For example, the transition structure performs impedance matching between a connector of 50 ohms and an SIW which has different impedance at every frequency.

Figure 25A:
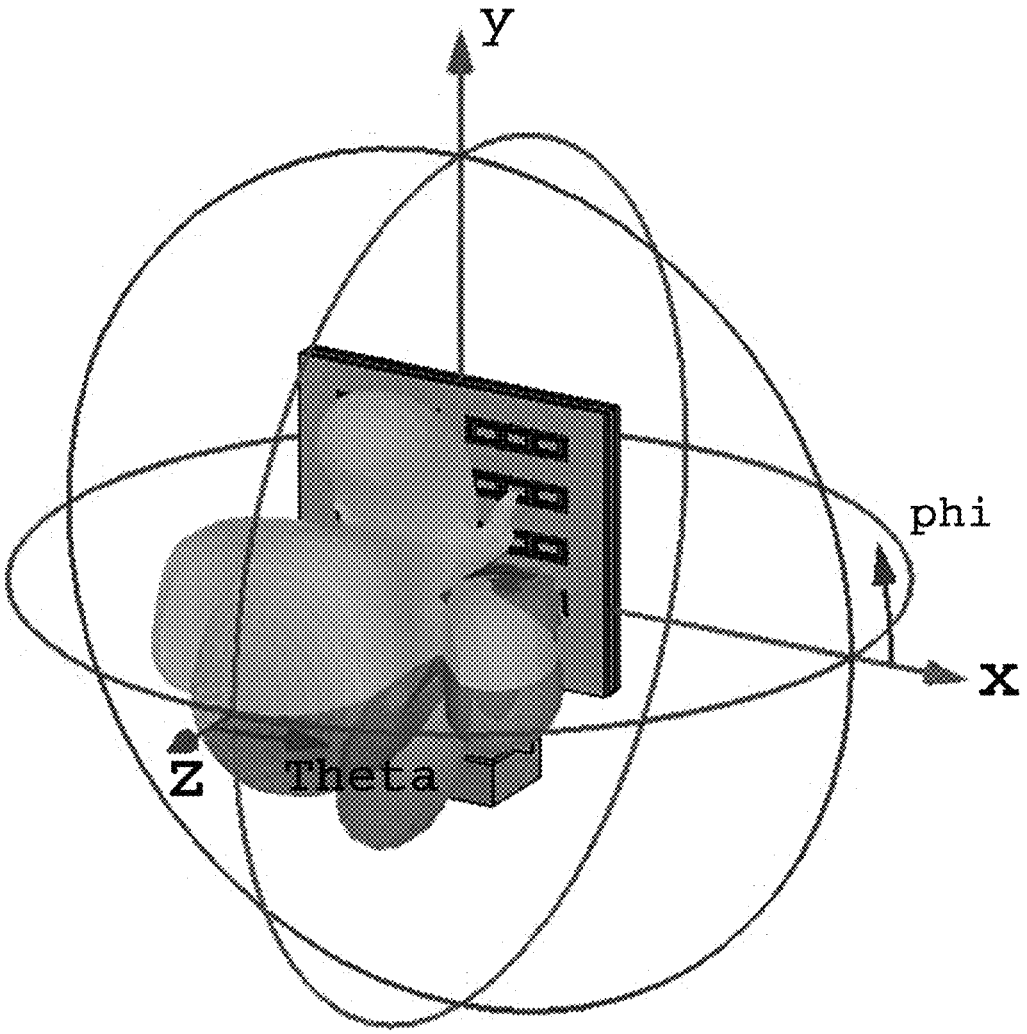
FIGS. 25A-25D are views illustrating a radiation characteristic and an antenna gain of a dual band antenna according to embodiments of the present invention.
Figure 25B:
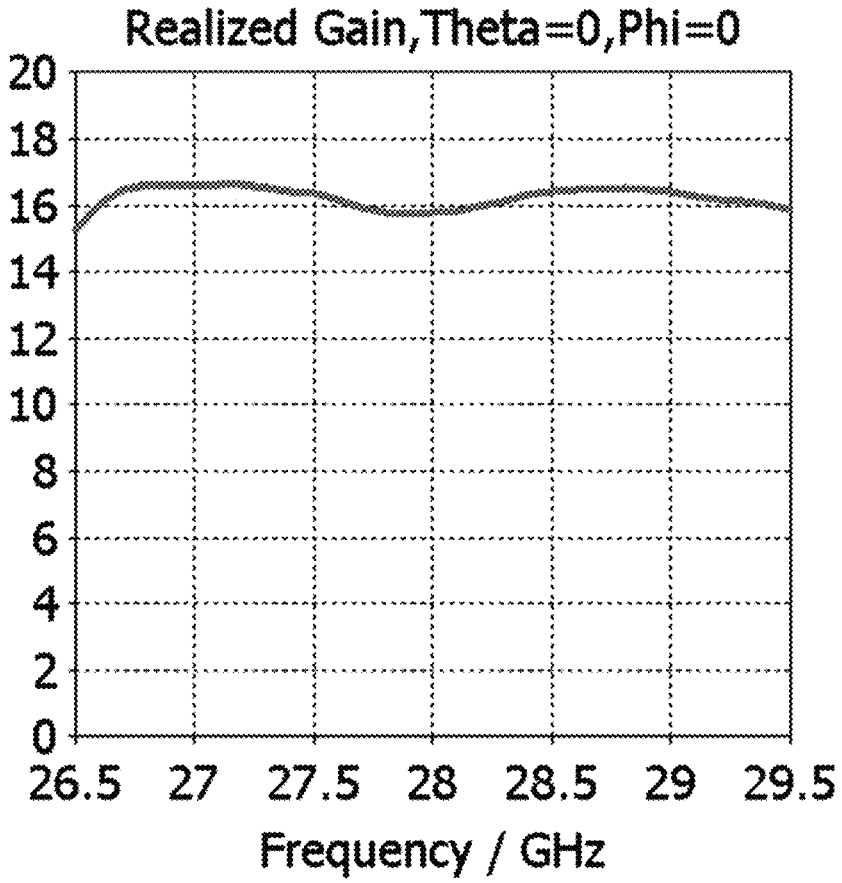
Figure 25C:
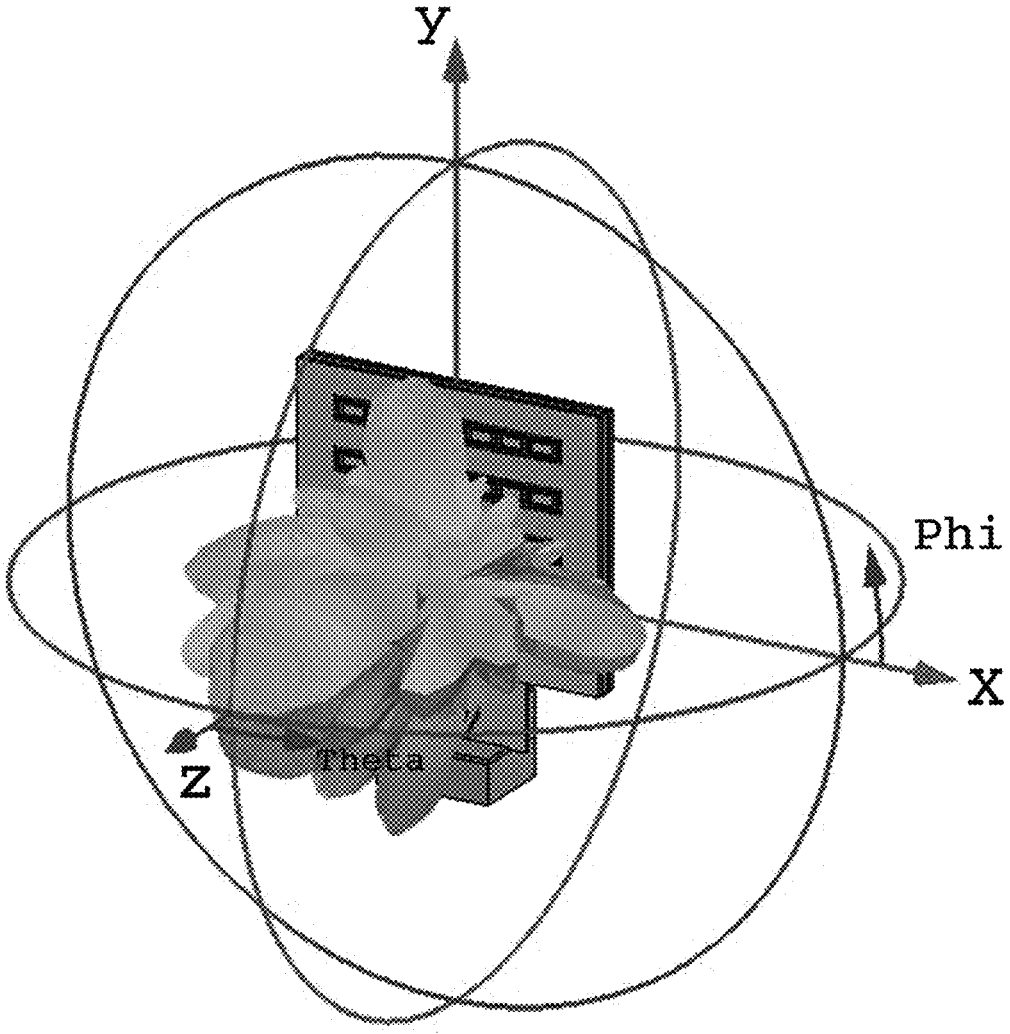
Figure 25D:
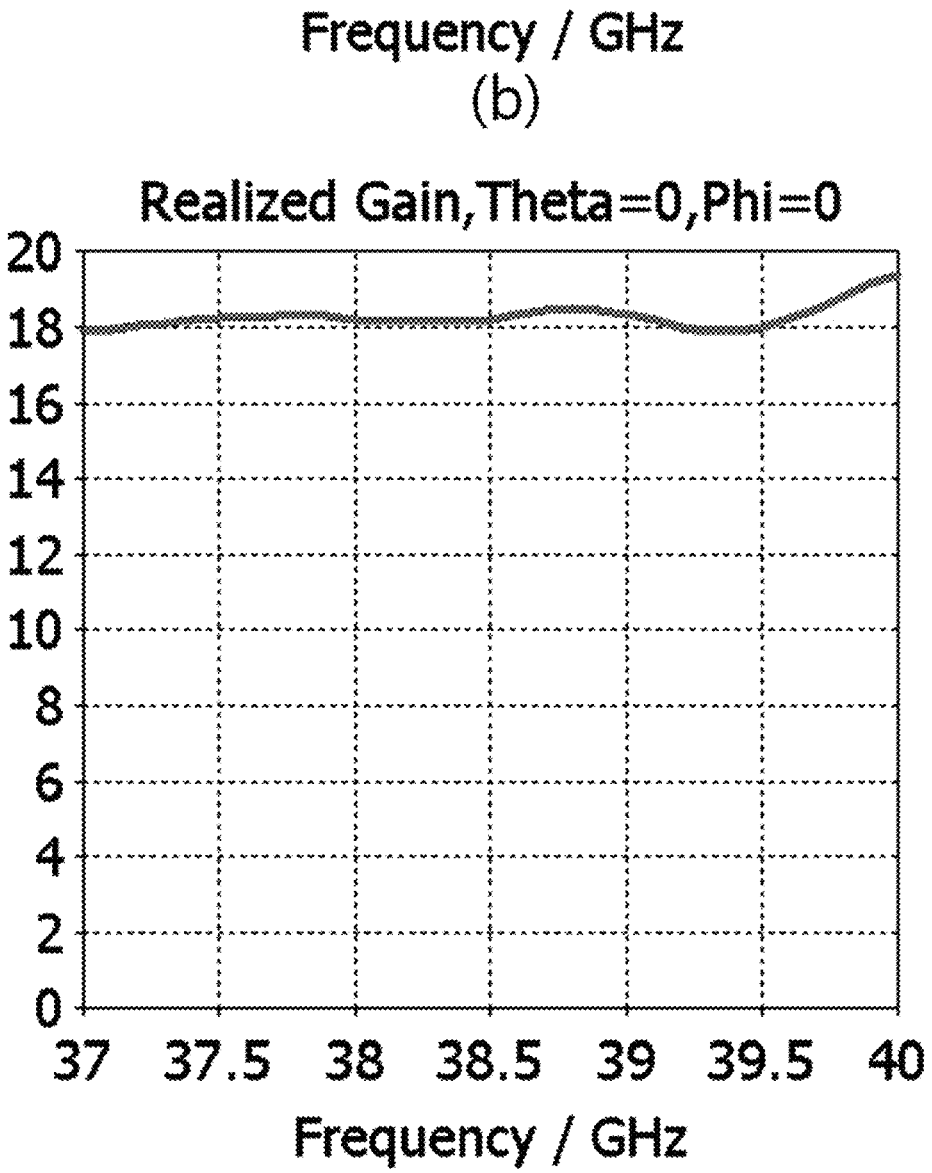

FIG. 25A is a view illustrating a radiation characteristic of a lower frequency band of a dual band antenna, FIG. 25B is a view illustrating an antenna gain of a lower frequency band of a dual band antenna, FIG. 25C is a view illustrating a radiation characteristic of an upper frequency band of a dual band antenna, and FIG. 25B is a view illustrating an antenna gain of an upper frequency band of a dual band antenna.

It is confirmed that the dual band antenna according to the present invention has a gain of approximately 16 dBi in a lower frequency band and a gain of approximately 18 dBi in an upper frequency band.

The present embodiments are provided to explain the technical spirit of the present embodiment and the scope of the technical spirit of the present embodiment is not limited by these embodiments. The protection scope of the present embodiments should be interpreted based on the following appended claims and it should be appreciated that all technical spirits included within a range equivalent thereto are included in the protection scope of the present embodiments.

What is claimed is:

1. A dual band antenna, comprising:

an antenna layer which radiates an electromagnetic wave in a dual frequency band through a dual slot; and a feed layer which applies a feed signal to the antenna layer, wherein the antenna layer and the feed layer are stacked, wherein the feed layer includes a first layer including a transmission slot and a second layer including a feed slot, wherein the antenna layer includes a third layer including a cavity slot and a fourth layer including an antenna slot, and wherein the first layer and the second layer are stacked, the second layer and the third layer are stacked, and the third layer and the fourth layer are stacked.

2. The dual band antenna according to claim 1, wherein the cavity slot of the third layer is disposed as a pair and the cavity slot pair is located at upper left and right in a diagonal direction of the feed slot of the second layer.

3. The dual band antenna according to claim 2, wherein the antenna slot of the fourth layer is disposed in a position corresponding to the cavity slot of the third layer.

4. The dual band antenna according to claim 2, wherein the antenna slot includes a lower band antenna slot which radiates an electromagnetic wave in a first frequency band and an upper band antenna slot which radiates an electromagnetic wave in a second frequency band, the upper band antenna slot is disposed as a pair in the lower band antenna slot and an interval antenna slot is disposed between the upper band antenna slot pair.

5. The dual band antenna according to claim 4, wherein the lower band antenna slot radiates an electromagnetic wave corresponding to a frequency band of 26.5 GHz to 29.5 GHz and the upper band antenna slot radiates an electromagnetic wave corresponding to a frequency band of 37.0 GHz to 40.0 GHz.

6. The dual band antenna according to claim 4, wherein when the dual band antenna operates in the first frequency band, distributions of an electric field are different and the arrangement of the polarities are different with respect to an imaginary reference line connecting the cavity slot pair so that dual resonance is formed.

7. The dual band antenna according to claim 4, wherein the third layer includes vias and a via which separates the electric field in the middle of the cavity slot pair is disposed and an inclined step shaped via is disposed at a lower end of the cavity slot pair.

8. The dual band antenna according to claim 7, wherein when the dual band antenna operates in the second frequency band, distributions of an electric field are different and the arrangement of the polarities are different with respect to an imaginary reference line connecting inner corners of the cavity slot pair at a curved upper end or lower end with the inclined step shape so that dual resonance is formed.

9. The dual band antenna according to claim 1, wherein the transmission slots of the first layer are symmetrically disposed to be spaced apart from each other to divide the feed signal received from the second layer.

10. The dual band antenna according to claim 9, wherein the Feed slots of the second layer are symmetrically disposed to be spaced apart from each other to divide the feed signal received from the first layer again.

11. The dual band antenna according to claim 1, wherein a plurality of matching vias for impedance matching is disposed to be close to the transmission slot of the first layer.

12. The dual band antenna according to claim 1, wherein a plurality of matching vias which matches the impedance is disposed to be close to a corner of a guide via which is disposed with an L shape in the first layer.

13. The dual band antenna according to claim 1, wherein a plurality of matching vias which matches the impedance is disposed in the center and a middle branch of a guide via which is disposed with an T shape in the first layer.

14. The dual band antenna according to claim 13, wherein when the dual band antenna operates in a dual frequency band, a feed signal is divided by a matching via disposed in the middle of the guide via disposed with a T shape in the first layer to be transmitted to the plurality of transmission slots located in the first layer and the transmitted feed signal is divided again to be transmitted to a plurality of feed slots located in the second layer from the plurality of transmission slots in phase.

15. The dual band antenna according to claim 1, wherein the second layer includes an inclined step structure transition structure connected to the feed connector.

* * * * *